US006135721A

United States Patent [19]

Hasbrouck

[11] Patent Number: 6,135,721

[45] Date of Patent: Oct. 24, 2000

[54] VACUUM OPERATED PUMPING SYSTEM

[76] Inventor: Allie Hall Hasbrouck, 610 W. Lock Port St., Suite 292, Plainfield, Ill. 60544

[21] Appl. No.: 09/133,217

[22] Filed: Aug. 13, 1998

[51] Int. Cl.[7] ..... F04F 1/06

[52] U.S. Cl. ..... 417/120

[58] Field of Search ..... 417/120, 126, 417/134, 138, 307

[56] References Cited

U.S. PATENT DOCUMENTS

| | | | |
|---|---|---|---|
| 1,321,296 | 11/1919 | Edwards . | |
| 1,453,486 | 5/1923 | Aebly . | |
| 1,860,688 | 5/1932 | Muzzy . | |
| 1,862,667 | 6/1932 | Edwards . | |
| 3,780,757 | 12/1973 | Jordan . | |
| 3,803,919 | 4/1974 | Tansony . | |
| 5,163,820 | 11/1992 | Karliner | 417/388 |
| 5,228,840 | 7/1993 | Swank | 417/211 |
| 5,425,333 | 6/1995 | Baylor et al. . | |
| 5,660,533 | 8/1997 | Cartwright | 417/435 |
| 5,713,723 | 2/1998 | Hathaway . | |
| 5,938,408 | 8/1999 | Krichbaum | 417/87 |

*Primary Examiner*—Teresa Walberg
*Assistant Examiner*—Vinod D Patel
*Attorney, Agent, or Firm*—Wallenstein & Wagner, Ltd.

[57] ABSTRACT

A vacuum operated pumping system is disclosed, and may include a single-, dual-, triple- or multiple-chamber arrangement. In one embodiment, the pumping system comprises a first chamber having a first liquid inlet, a first liquid outlet, and a first air port communicating with a first air line. An inlet conduit communicates with the first liquid inlet and a liquid supply source. An inlet check valve is adapted to prevent liquid from flowing from the first chamber toward the liquid supply source, while an outlet check valve is adapted to prevent liquid from flowing through the first liquid outlet toward the first chamber. A second chamber is provided having a second liquid outlet. The second chamber communicates with the first liquid outlet. A vacuum generator is placed in operable communication with the first air line and a compressed air source. A sensor such as a float assembly detects a level of liquid contained in the first chamber. Also provided are one or more solenoid valves and pressure regulators for directing air flow from the compressed air source to the vacuum generator in response to a detected low level of liquid contained in the first chamber, and for directing the air flow to the first air line in response to a detected high level of liquid contained in the first chamber.

38 Claims, 22 Drawing Sheets

| SS1 | OPEN | CLOSE |
|---|---|---|
| RUN | 3-4 | 1-2<br>5-6 |
| OFF | 1-2<br>3-4<br>5-6 | |
| EMPTY | 1-2<br>5-6 | 3-4 |

VACUUM OPERATED PUMPING SYSTEM

DESCRIPTION

1. Technical Field

The present invention relates to the transfer of fluid by pumping action. In particular, the present invention relates to a pumping system wherein fluid is cyclically moved under the influence of a vacuum-generated pressure differential.

2. Background of the Invention

Several types of mechanical pumps for transferring fluid are known and in wide use. The two most basic classifications are positive displacement pumps and dynamic or momentum-change pumps. Dynamic pumps add momentum to a fluid by means of rapidly moving blades, fans or the like. As the fluid moves through open passages and discharges into a diffuser section, its momentum is increased and its velocity converted into an increased pressure. Dynamic pumps include rotary or rotodynamic types, such as centrifugal or radial exit flow, axial flow, and mixed flow pumps. Also included are jet or ejector pumps, electromagnetic, and fluid actuated types such as gas-lift and hydraulic-ram pumps.

The centrifugal pump is a popular type of dynamic pump that consists mainly of a rotating vane-type impeller that is enclosed in a stationary casing. The liquid being pumped is drawn in through the "eye" of the impeller and is thrown to the outer edge or periphery of the impeller by centrifugal force. Considerable velocity and pressure are imparted to the liquid in the process. The liquid leaving the periphery of the impeller is collected in the casing and directed through the discharge opening. Frequently, the impeller of the pump is mounted directly on the shaft of the pump-driving motor so that the pump and motor are an integral unit. In other cases, the pump and motor are separate units and are connected together by a flexible coupling.

Positive displacement pumps all generally have some type of a moving boundary that forces fluid to move by volume changes. The fluid is admitted through an inlet into a cavity, which then closes, and the fluid is squeezed through an outlet. Classifications include reciprocating and rotary types. Reciprocating types utilize a piston, plunger or diaphragm as the moving boundary. Rotary types utilize one or more sliding vanes, flexible tubes or linings, helical screws, gears, lobes, circumferential pistons, or peristaltic contraction. In a reciprocating pump, for example, a moving boundary may be a piston. The piston is driven by a connecting rod that reciprocates off of a rotating crankshaft enclosed in a crankcase. In a rotary pump, a moving boundary may be a rolling piston revolving on an eccentric shaft mounted concentrically in a cylinder; a series of rotating vanes or blades mounted about the periphery of a slotted rotor shaft mounted eccentrically in a cylinder; or a pair of mated, enmeshed helically grooved rotors lobes (screw) housed in a cylinder, wherein the male rotor contains a series of lobes that mesh with corresponding flutes on the driven female rotor.

From the above discussion, it is clear that known pumps require several moving components having a large mass or density. These components are subject to large accelerations and friction, are prone to wear and vibration, and require costly and time-consuming maintenance. Depending on the particular design, prior art pumps require for their operation compression and oil rings, oil grooves, packings, seals, bushings, bearings, valves, cams, springs, liners, sleeves or jackets, and other machined components. They also require elaborate lubrication, cooling and control systems involving additional components, such as servos, equalizing and bypass lines, bleed holes, filters, desiccant dryers, reservoirs, and even additional pumps. They incur high design, manufacturing and operating costs, which are by necessity allocated to the consumer or end user. Finally, they usually require some means for priming the system prior to effective operation, and are subject to damage due to neglect by the operator.

The present invention is provided to solve these and other problems associated with known pumps.

SUMMARY OF THE INVENTION

The present invention is provided to emulate the pumping action of conventional pumps, and achieve or surpass the transfer efficiency and capacity of such pumps. The present invention realizes high pumping performance, while at the same time eliminates structural and operational complexity and reduces the significance of cost and maintenance issues. In particular, the present invention relies on no components to move or transfer fluid within its associated system. Importantly, there is no moving boundary or rotating device. The only moving parts subject to wear are minor control devices such as a level sensor and one or more check valves, regulators and solenoid valves. These parts are relatively inexpensive and easily replaceable.

The present invention is operable over a wide range of temperatures, pressures and flow rates. The flow may be pulsed or kept uniform. The operating pressure on the system may be adjusted to deliver a strong turbulent flow or a low-energy laminar flow. Foaming may be controlled. In addition, a wide range of fluids of varying viscosities and compositions may be pumped. For instance, an ink having a viscosity measured at 1.5 min. #2 Zahn cup has been successfully tested. Liquids may be mixed and kept homogenous without the use of mechanical agitators or paddles.

As will also become evident from the balance of the disclosure, the present invention does not require lubrication and cooling systems. Hence, there is no danger of contamination of the fluid to be pumped such as by oil, grease, silicone and the like, and no attraction of dust or dirt. Potable water, intravenous solutions, blood, or sensitive chemicals could be pumped, for instance. Furthermore, the costs of maintaining lubrication and cooling systems are eliminated. As there are no moving parts coming into contact with the fluid, suspensions containing flock or solids are not subject to shear and do not clog the system. Many types of abrasive solutions are compatible. Neither is the present invention subject to deleterious conditions such as stalling, mechanical binding, locked-rotor, vapor lock, or cavitation. For example, in the operation of the present invention it has been observed that, where a pipe or conduit becomes blocked, the system will remain stable without incurring damage. The system can be left activated and run dry with no fluid being pumped, without adverse effect; the system will simply continue to circulate air. Thus, many of the elaborate safety and motor control circuits needed for prior art systems are eliminated.

Moreover, because there are no moving parts of significant mass, the only parasitic friction loss generated is that caused by the fluid pumped through the various conduits chosen for the system. In terms of wear, maintenance and transfer efficiency, this friction energy is negligible. Virtually all of the energy harnessed for use in the system is transferred directly for use in moving the fluid. The elimination of friction also makes the present invention highly suitable for pumping fluids which are sensitive to positive heat transfer. Thus, the present invention ensures that the viscosities and other properties of fluids such as oils and polymers are not compromised. Finally, the embodiments disclosed may be assembled and disassembled in a matter of seconds.

Accordingly, in one embodiment of the present invention, a pumping system comprises a pumping chamber having a liquid inlet and a liquid outlet. The liquid inlet communicates with a liquid supply source. Means are provided for sensing high and low liquid volume levels in the pumping chamber. Means for cycling the chamber between fill and empty states operably communicates with the sensing means and includes means for decreasing a level of pressure within the pumping chamber below a level of pressure within the liquid supply source in response to a sensed low liquid volume level, and means for increasing the level of pressure within the pumping chamber in response to a sensed high liquid volume level. The pumping system may further comprise a receiving chamber communicating with the liquid outlet and having a receiving chamber outlet, and means for maintaining a constant flow rate of liquid through the receiving chamber outlet.

In another embodiment, a pumping system comprises a chamber having a liquid inlet, a liquid outlet, and an air port that communicates with an air line. An inlet conduit communicates with the liquid inlet and a liquid supply source. An inlet check valve is adapted to prevent liquid from flowing from the chamber toward the liquid supply source, while an outlet check valve is adapted to prevent liquid from flowing through the liquid outlet toward the chamber. A vacuum generator is placed in operable communication with the air line and a compressed air source. Means are provided for detecting a level of liquid contained in the chamber. Also provided are first means for directing air flow from the compressed air source to the vacuum generator in response to a detected low level of liquid contained in the chamber, and second means for directing the air flow to the air line in response to a detected high level of liquid contained in the chamber.

In another embodiment, a pumping system comprises a first chamber having a first liquid inlet, a first liquid outlet, and a first air port communicating with a first air line. An inlet conduit communicates with the first liquid inlet and a liquid supply source. An inlet check valve is adapted to prevent liquid from flowing from the first chamber toward the liquid supply source, while an outlet check valve is adapted to prevent liquid from flowing through the first liquid outlet toward the first chamber. A second chamber is provided having a second liquid outlet. The second chamber communicates with the first liquid outlet. A vacuum generator is placed in operable communication with the first air line and a compressed air source. Means are provided for detecting a level of liquid contained in the first chamber. Also provided are first means for directing air flow from the compressed air source to the vacuum generator in response to a detected low level of liquid contained in the first chamber, and second means for directing the air flow to the first air line in response to a detected high level of liquid contained in the first chamber.

In another embodiment, a pumping system comprises a first chamber having a first liquid inlet, a first liquid outlet and a first air port, wherein the first air port communicates with a first air line. A first inlet conduit communicates with the first liquid inlet and a liquid supply source. A first inlet check valve is adapted to prevent liquid from flowing from the first chamber toward the liquid supply source, while a first outlet check valve is adapted to prevent liquid from flowing through the first liquid outlet toward the first chamber. A second chamber is provided having a second liquid inlet, a second liquid outlet and a second air port, wherein the second air port communicates with a second air line. A second inlet conduit communicates with the second liquid inlet and the liquid supply source. A second inlet check valve is adapted to prevent liquid from flowing from the second chamber toward the liquid supply source, while a second outlet check valve is adapted to prevent liquid from flowing through the second liquid outlet toward the second chamber. A third chamber is further provided. The third chamber has a third liquid outlet and communicates with the first and second liquid outlets. A vacuum generator is placed in operable communication with the first and second air lines and a compressed air source. The pumping system further comprises first means for detecting a level of liquid contained in the first chamber, and second means for detecting a level of liquid contained in the second chamber. First means are provided for directing a first air stream from the compressed air source to the vacuum generator in response to a detected low level of liquid contained in the first chamber, as well as second means for directing the first air stream to the first air line in response to a detected high level of liquid contained in the first chamber, third means for directing a second air stream from the compressed air source to the vacuum generator in response to a detected low level of liquid contained in the second chamber, and fourth means for directing the second air stream to the second air line in response to a detected high level of liquid contained in the second chamber.

In another embodiment, a pumping system comprises a pumping chamber having a liquid inlet and a liquid outlet, a vacuum generator operably communicating with the chamber and a compressed air source, and a timing device adapted to cycle a solenoid unit between fill and empty stages at predetermined intervals. During the fill stage, the solenoid unit is adapted to direct air from the compressed air source to the vacuum generator, and during the empty stage, the solenoid unit is adapted to direct air from the compressed air source to the chamber.

A method for pumping liquid through a chamber is also disclosed.

Other features and advantages of the invention will be apparent from the following specification taken in conjunction with the following drawings.

DETAILED DESCRIPTION OF THE INVENTION

Figure 1:
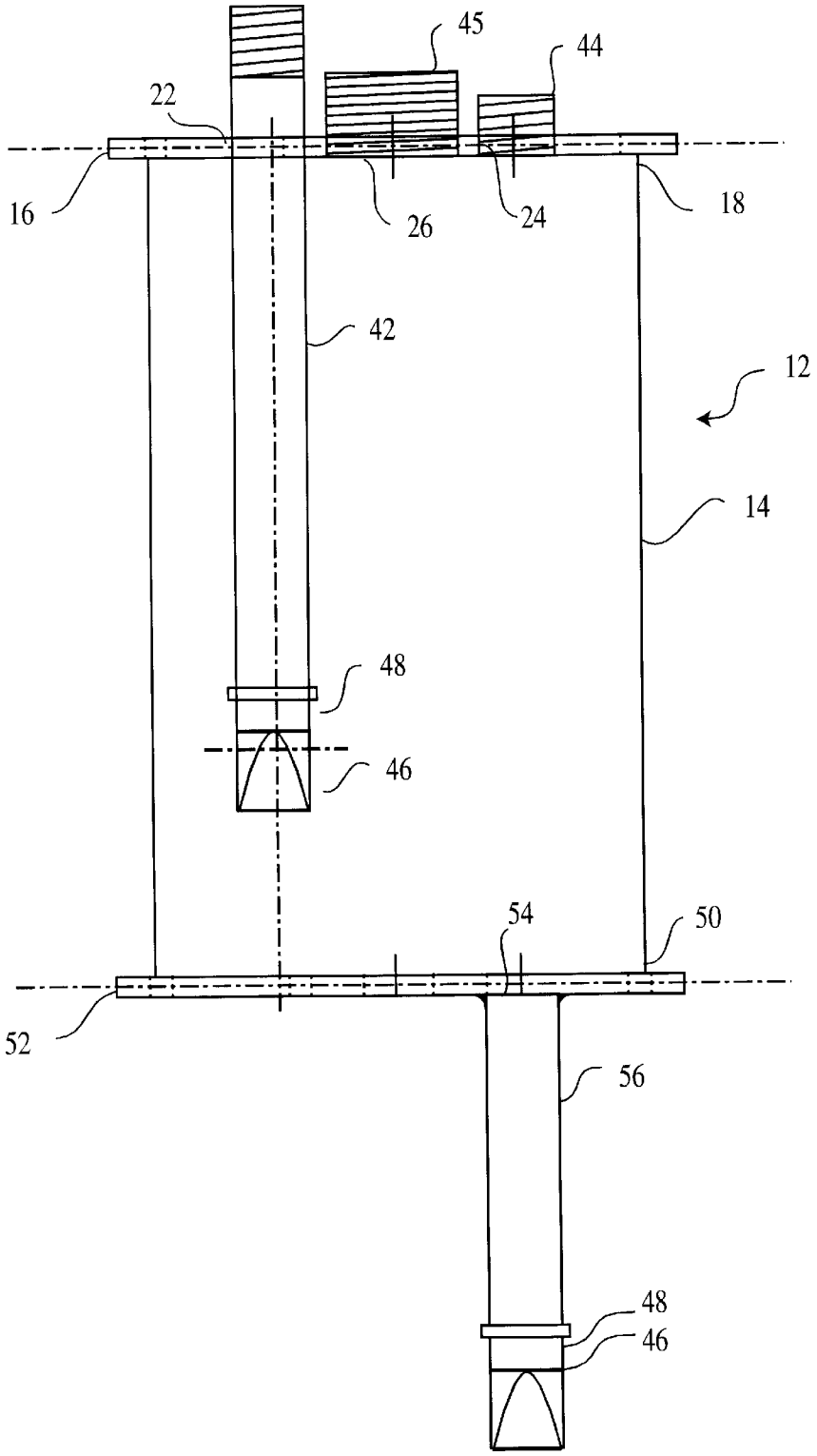
FIG. 1 is a side elevational view of a chamber according to one embodiment of the present invention.

While this invention is susceptible of embodiments in many different forms, there is shown in the drawings and will herein be described in detail preferred embodiments of the invention, with the understanding that the present disclosure is to be considered as an exemplification of the principles of the invention and is not intended to limit the broad aspect of the invention to the embodiments illustrated.

FIRST EMBODIMENT

FIGS. 1–10 illustrate a single chamber pumping system 10. Referring to FIG. 1, the pumping system 10 has a pumping chamber 12. The pumping chamber 12 includes an outer wall or housing 14, the geometry of which may be cylindrical or otherwise. To enable observation of the contents of the pumping chamber 12 and fluid movement therein, the outer wall 14 may be constructed of a transparent, rigid material such as an acrylic polymer. This material is available under the trademark LEXAN and, in the embodiments described herein, can withstand 2000 psi fluid pressure. Other suitable material, transparent or opaque, may be used. In FIG. 1, the pumping chamber 12 is vertically oriented, although it may also be horizontally oriented. The pumping chamber 12 is sealed in part by securing a barrier, such as an upper stainless steel plate 16, to an upper end 18 of the outer wall 14. An air-tight seal is preferably achieved by placing a gasket between the upper end 18 and the upper plate 16, or by applying an RTV silicone sealant.

Figure 2:
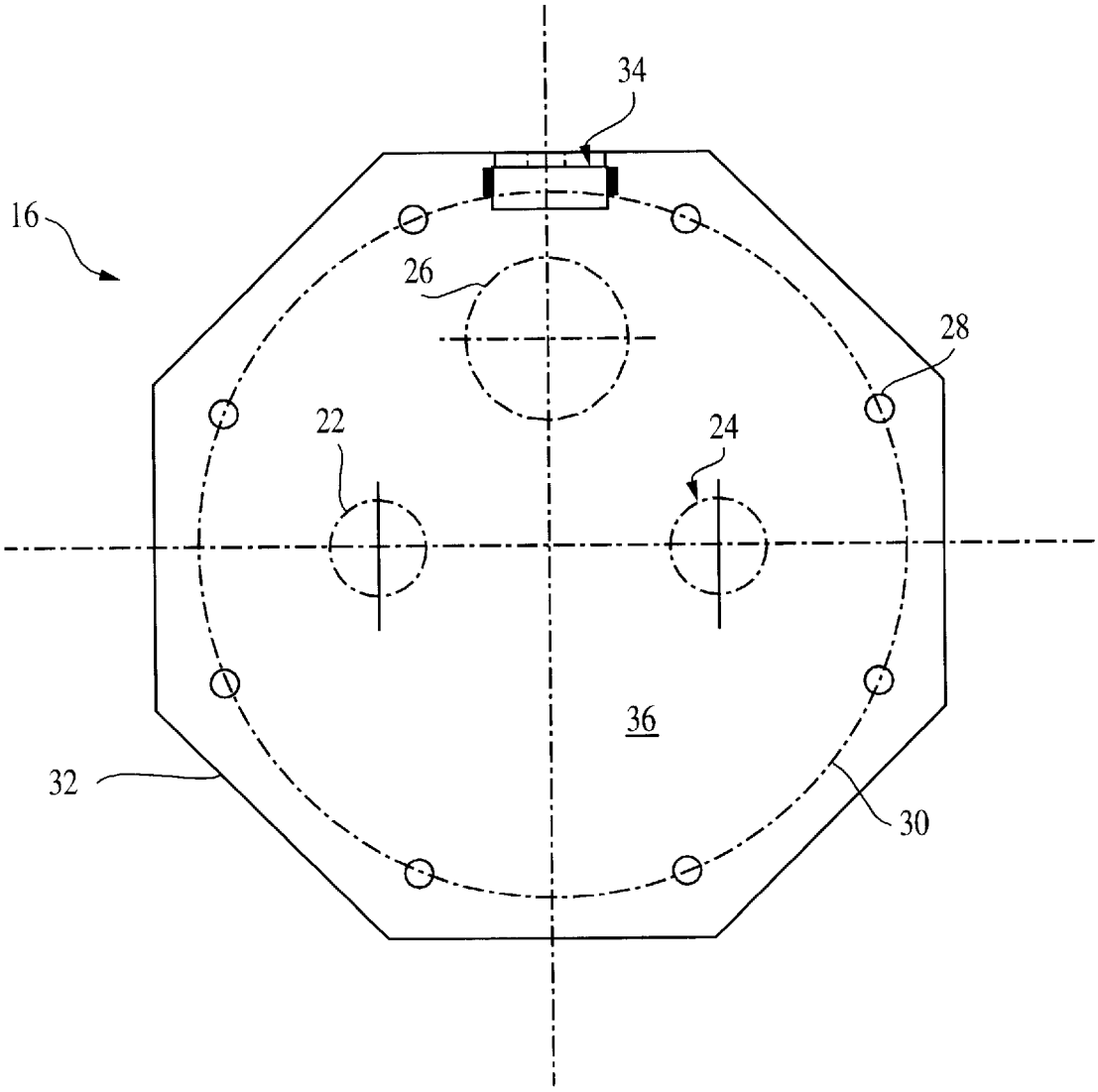
FIG. 2 is a top view of a plate of the chamber of FIG. 1.

As shown in FIG. 2, the preferred upper plate 16 has a number of holes bored therethrough, including a liquid inlet 22, an air port 24, and a level sensor mounting bore 26. To assist in mounting and reduce space, the upper plate 16 has also been chamfered at 45-degree angles to form an octagonal cross-section. A plurality of tie rod mounting bores 28 are equidistantly spaced in a circumferential pattern 30 inset at a distance from each flat 32 of the upper plate 16. Where it is desired to mount the pumping chamber 12 to a wall, machine or other structure, an angle iron 34 may be provided and welded to a top face 36 of the upper plate 16.

Figure 3:
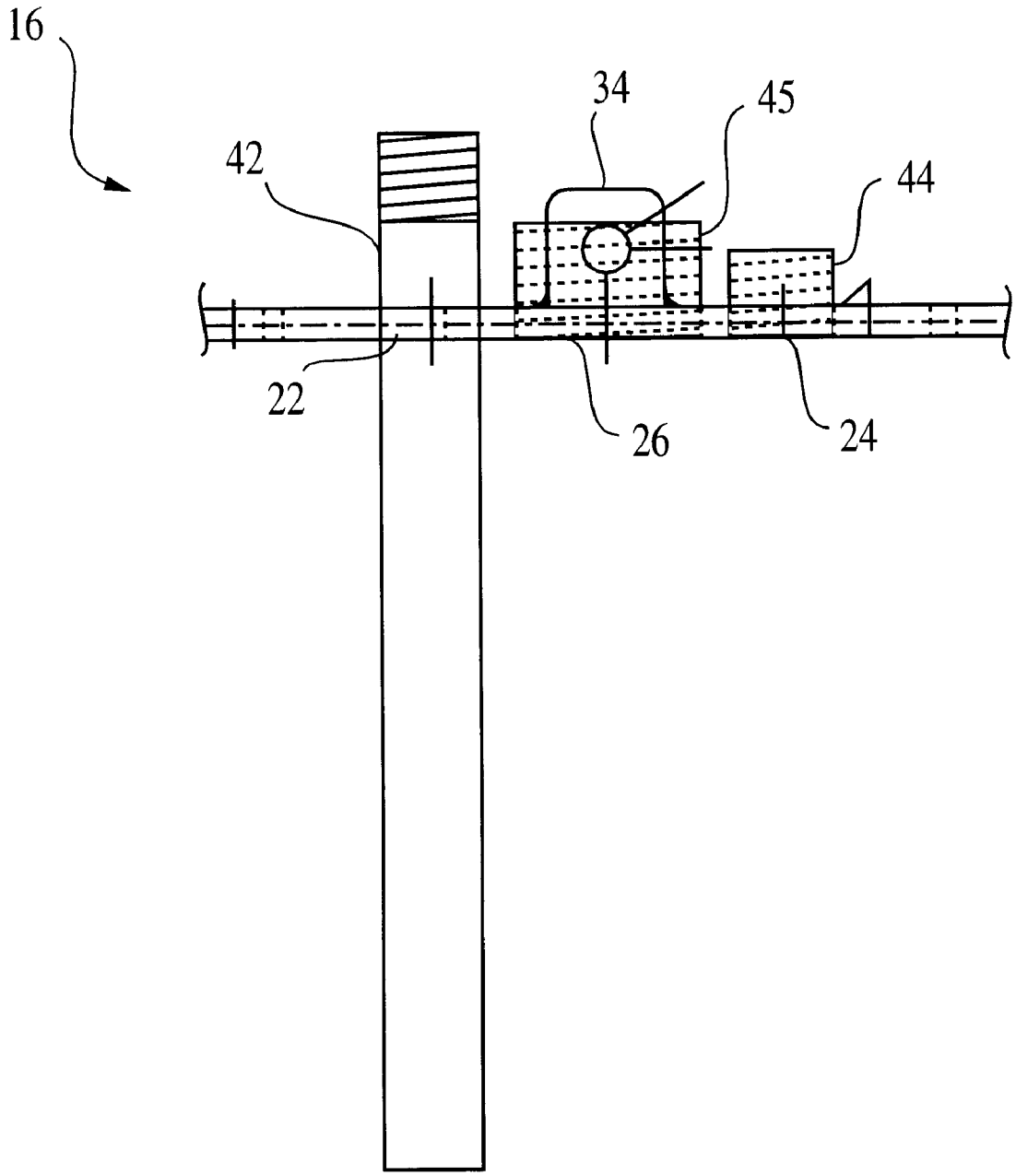
FIG. 3 is a side elevational view of the plate of FIG. 2.

As best shown in FIG. 3, threaded fittings are secured such as by conventional welding to the holes of the upper plate. A liquid inlet fitting 42 is secured to the liquid inlet 22, an air port fitting 44 is secured to the air port 24, and a level sensor fitting 45 is secured to the level sensor mounting bore 26. Preferably, such fittings will be rigid whereas any conduits connected to the fittings may be flexible, as further described below.

As described below, a line of liquid flow will be established into the pumping chamber 12 through the liquid inlet 22. To prevent backflow out of the pumping chamber 12 through the liquid inlet, a check valve should be installed at some point along the liquid flow line. Accordingly, in FIG. 1 a duck bill check valve 46 has been sealingly fitted to the liquid inlet fitting 42 using an adjustable metal band or clamp 48 of known design. The duck bill check valve 46 has been chosen for its superior performance, long service life, and ease of maintenance and replacement. Other types, such as ball-and-cage check valves, may be substituted. The duck bill check valve 46 has been installed within the pumping chamber 12 for convenience, but may be installed anywhere along the liquid flow line.

Figure 4:
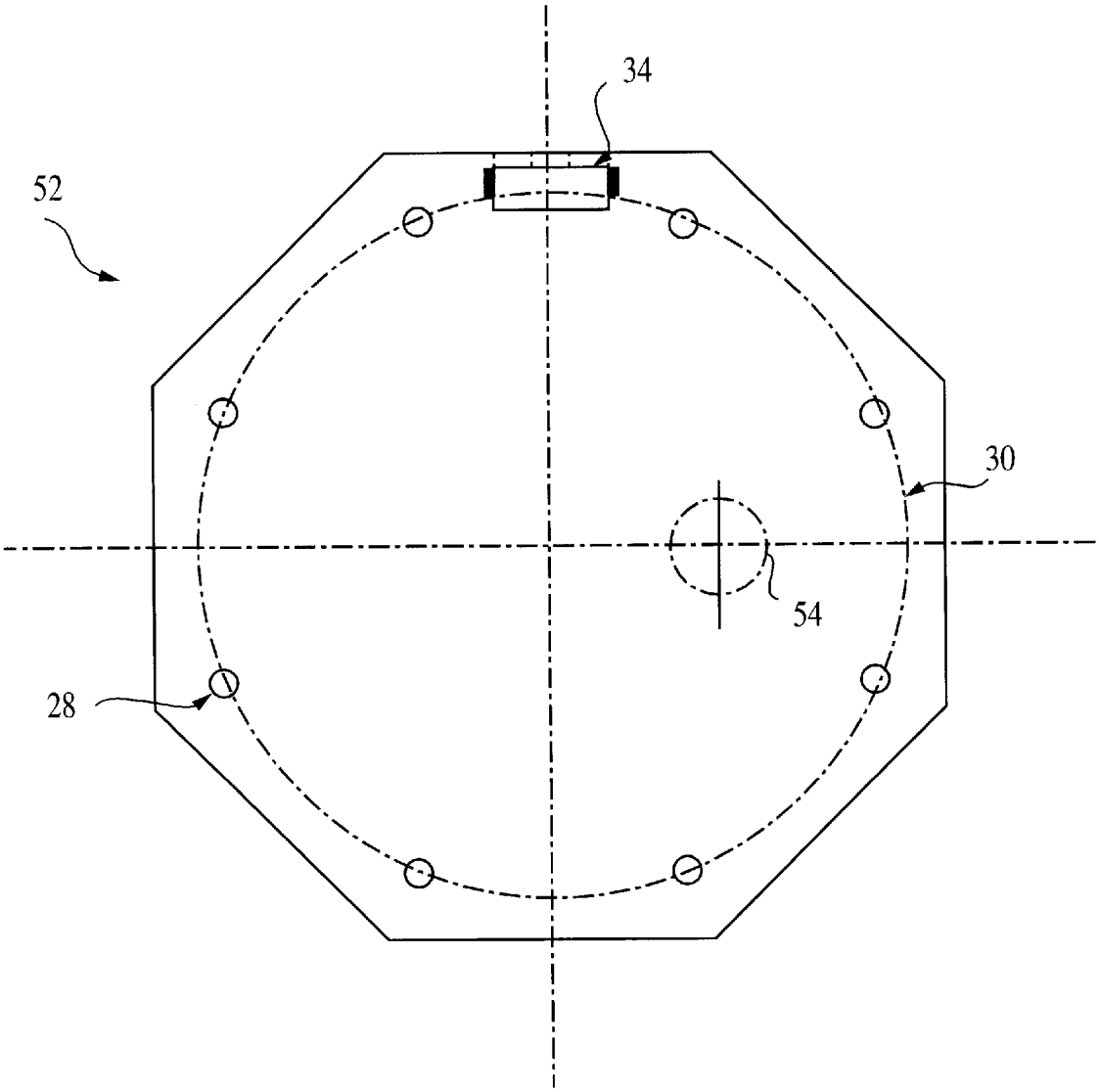
FIG. 4 is a bottom view of another plate of the chamber of FIG. 1.
Figure 5:
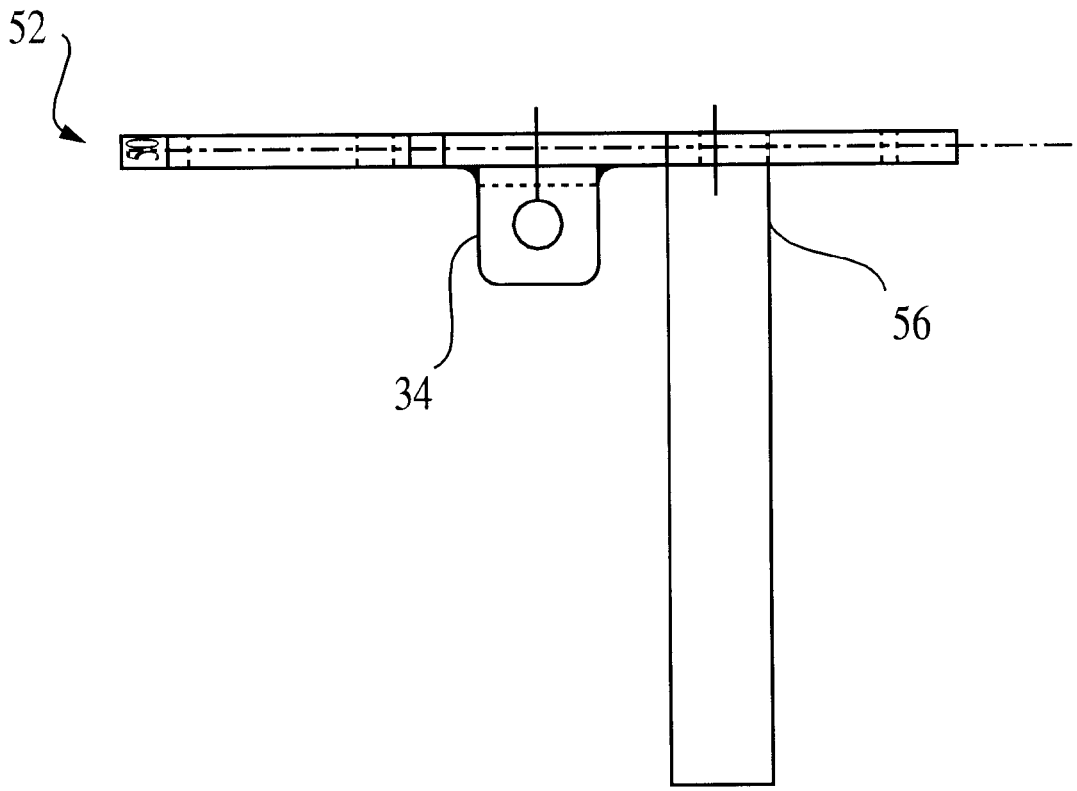
FIG. 5 is a side elevational view of the plate of FIG. 4.

The pumping chamber 12 is sealed at a lower end 50 of the outer wall 14 in a manner similar to the upper end 18. That is, a barrier, such as a stainless steel lower plate 52, is sealed to the lower end 50. As shown in FIG. 4, the preferred lower plate 52 is shaped in a manner similar to that of the upper plate 16, and may include an angle iron 34 or other structure for mounting purposes. A liquid outlet 54 is bored through the lower plate 52, and a plurality of threaded tie rod mounting bores 28 are equidistantly spaced in a circumferential pattern 30 of the lower plate 52. As shown in FIG. 5, a liquid outlet fitting 56 may be attached to the lower plate 52 such as by welding, in register with the liquid outlet 54. As described below, a line of liquid flow will be established out of the pumping chamber 12 through the liquid outlet 54. To prevent backflow into the pumping chamber 12 through the liquid outlet 54, a duck bill or other type of check valve 46 should be installed at some point along the liquid flow line. In FIG. 1, the duck bill check valve 46 has been sealingly fitted to the liquid outlet fitting 56 using an adjustable metal band 48, although the duck bill check valve may be installed elsewhere along this liquid flow line.

For the pumping chamber 12 described in the present embodiment, it has been found advantageous to ensure a good seal by providing the upper and lower plates 16,52, and then employing a plurality of tie rods 58 (see FIG. 6) to create equally distributed axial tension between the upper and lower plates 16,52 and the outer wall 14. Each tie rod 58 is preferably stainless steel and threaded at opposite ends. The tie rods 58 are extended through the tie rod mounting bores 28 of the upper plate 16 and threaded into the corresponding threaded tie rod mounting bores 28 of the lower plate 52. The tie rods 58 may be tightened down at each end with box or acorn nuts or similarly functioning fasteners.

It will be understood that blocks (not shown) may be substituted for the upper and lower plates 16,52. Because of their greater thickness, the blocks may contain fluid passages and ports to which all necessary fittings are connected.

The particular dimensions for the pump will depend on the volumetric flow rate required, the viscosity of the liquid to be pumped, the total (i.e., static and friction) head against which the pump must operate in its intended environment, as well as other parameters. Representative dimensions for the primary structural components of the pumping system 10 shown in FIGS. 1–5, without manufacturing tolerances, are as follows:

| | |
|---|---|
| Outerwall 14: | 10-in. length, 6-in. width or dia., 0.25-in. thickness |
| Upper and lower plates 16, 52: | 7 in. flat-to-flat, 0.25-in. thickness |
| Angle irons 34 | 1 × 1 in., with 0.3906-in. dia. hole |
| Liquid inlet 22: | 0.8594-in. dia. |
| Air port 24: | 0.8906-in. dia. |
| Level sensor mounting bore 26: | 1.5938-in. dia. |
| Tie rod mounting bores 28: | 0.2570-in. dia. |
| Tie rods 58: | 11.0600-in length, 0.2500-in. dia. |
| Circumferential patterns 30: | 6.3040-in. dia. |
| Liquid inlet fitting 42: | 8.8750-in. length, 1.5000 in. extending from top face 36 of upper plate 16 |
| Air port fitting 44: | 0.7500-in. length |
| Level sensor fitting 45: | 0.9889-in. length |
| Liquid outlet 54: | 0.8594-in. dia. |
| Liquid outlet fitting 56: | 6.0000-in. length |

Figure 6:
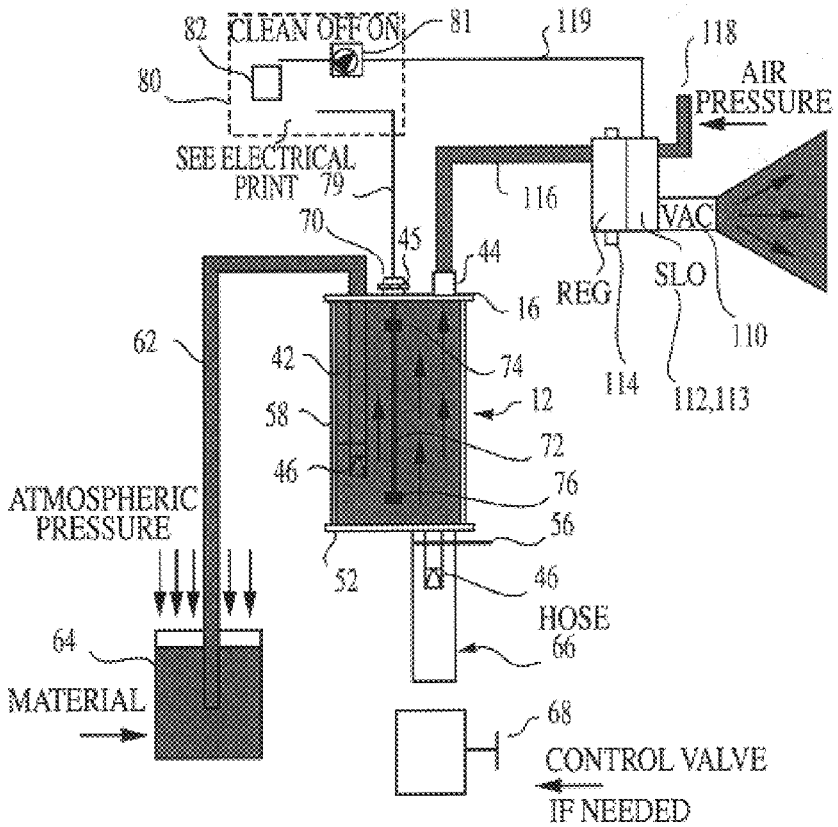
FIG. 6 is a diagrammatic view of a pumping system according to one embodiment of the present invention.

FIG. 6 illustrates the pumping chamber 12 installed in operative communication with other components of the pumping system 10. A liquid inlet conduit 62 is fitted at one end to the liquid inlet fitting 42. An opposite end of the liquid inlet conduit 62 is placed in communication with a liquid supply source 64, such that the liquid inlet conduit 62 provides fluid communication between the liquid supply source 64 and the pumping chamber 12. The liquid inlet conduit 62 may include one or more hoses, pipes, flow valves, elbow fittings and the like as needed. As the pumping performance of the present invention depends primarily on the establishment of a fluid pressure differential, the liquid supply source 64 may be either open (as shown in FIG. 6) or closed to the atmosphere. Also, because the pumping system 10 is not significantly affected by hydrostatic forces, potential energy factors or other gravitational considerations, the liquid supply source 64 may be disposed above or below the pumping chamber 12. A liquid outlet conduit 66 may be connected to the liquid outlet fitting 56 and placed in communication with an apparatus or other desired destination for the liquid to be pumped. A flow control valve 68 and/or pressure regulator may be installed along the liquid outlet conduit 66 as needed.

To measure the volume or level of liquid present in the pumping chamber 12 at any given time, a level sensor 70 or equivalent device is installed within the pumping chamber 12. There are a number of suitable level sensors available for use in the present invention, which may be mounted externally or internally of the pumping chamber 12. In the present embodiment, the level sensor 70 has been installed at the level sensor fitting 45 of the upper plate 16 and extends downward, and hence may be removed and inspected without disassembly of other components of the pumping system 10. The particular level sensor 70 chosen includes a brass or stainless steel stem 72 about which at least one float is slidably mounted. For the best control of pumping conditions within the pumping chamber 12, it is preferable to include an upper float 74 and a lower float 76. A variety of materials are suitable for construction of the upper and lower floats 74,76, including Buna N, stainless steel, polysulfone, polypropylene, PVC, SST, or combinations thereof. For example, Buna N may be selected as the buoyant material for each float 74,76 and protected by a stainless steel shell. One or more reed switches, preferably of the single pole-single throw (SPST) type, are housed within the stem 72 in operable communication with the upper and lower floats 74,76. One example of a suitable level sensor 70 is a dual-float level switch available from Thomas Products, Ltd., designated as Model 4000. An electrical wire 79 provides communication between the level sensor 70 and a control box 80.

A vacuum generator 110, one or more solenoid valves 112,113, and one or more air flow regulators 114 are also provided, in communication with an air line 116 sealingly fitted to the air port fitting 44. An additional air line 118 runs from a compressed air source (not shown) to the solenoid valves 112,113. In the present embodiment, the valving and regulation functions may be integrated in a single, modular, 4-way pilot-operated, dual regulator/dual pressure solenoid unit available from MAC Valves and selected from that company's "92 Series." This particular unit consumes a minimal amount of energy. Air line lubrication is not necessary, although the use of an air line filter may be desirable to extend the cycle life of the valves. The unit contains two adjustable regulators interconnected between a manifold base block and two solenoid valves. Air paths are determined by an air-driven aluminum spool within the regulator housing. Pressure gages may be connected to each regulator. One regulator is used to control air pressure to the pumping chamber 12, while the other regulator controls pressure to the vacuum generator 110. The preferred vacuum generator 110 is available from PIAB USA, Inc., designated as a type-M vacuum pump in that company's "Chip" series. This unit has a minimally-sized, multistage ejector design which operates at a low noise level and over a wide range of feed and vacuum pressures.

Although a single air line 116 to control air pressure in the pumping chamber 12 is shown, additional air lines could be provided. One air line could be used to deliver compressed air into the pumping chamber 12 while a second air line could be used to evacuate the pumping chamber 12.

An electrical wire 119 provides communication between the solenoid valves 112, 113 and the control box 80. Depending on the circuitry employed in the control box 80, additional electrical wires may run from the control box 80 to the control valve 68 of the liquid outlet conduit 66 and to any control valve installed along the liquid inlet conduit 62. The control box 80 should include a standard, 3-position selector switch 81 and a control relay 82. The selector switch 81 is the only control requiring manipulation by an operator.

In applications where it is not desirable to employ electrical means for air regulation, pneumatic timers and switches may be used to control the pumping cycle in combination with air-piloted solenoid valves. Additionally, where it is not desirable to employ float devices within the pumping chamber 12, repeat cycle timers may be used to cycle the system and are available from Omron.

The operation of the pumping system 10 will now be described with reference to FIGS. 6–10. For the sample embodiment shown, it is assumed that the liquid supply source 64 is open to the atmosphere and thus subject to ambient conditions. To begin pumping liquid from the liquid supply source 64, the selector switch is moved to its ON position to initiate a FILL stage. The solenoid valves 112, 113 are energized and moved to a position permitting compressed air to flow from the compressed air source, through the air line 118 and solenoid valves 112,113, and to the vacuum generator 110. The action of the compressed air flowing through the vacuum generator creates a vacuum in the air line 116 and, consequently, the pumping chamber 12. The duck bill check valves 46 are normally closed by design, hence assuring that the pumping chamber 12 is sealed from the atmosphere at this time. However, the pressure in the pumping chamber 12 will drop below the pressure in the liquid inlet conduit 62, causing any air within the liquid inlet conduit 62 to evacuate into the pumping chamber 12 and eventually flow through the vacuum generator 110.

Figure 7:
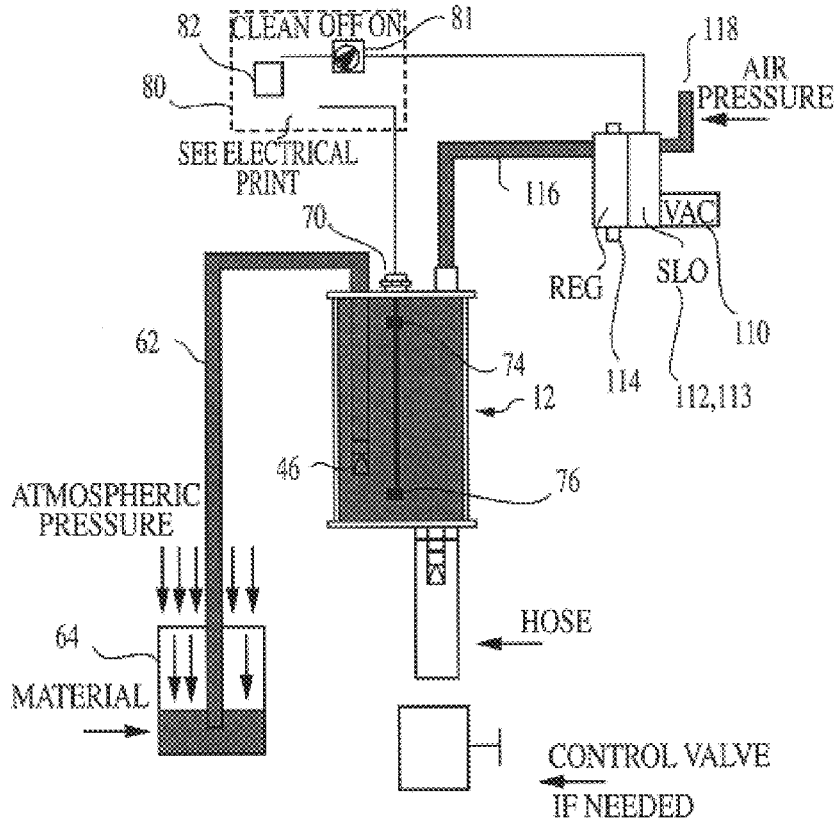
FIG. 7 is another diagrammatic view of the pumping system of FIG. 6.

As shown in FIG. 7, at some point the pressure in the pumping chamber 12 will drop below the pressure in the liquid supply source 64, i.e., atmospheric pressure in the present example. Liquid in the liquid supply source 64 is then forced to flow through the liquid inlet conduit 62 and its check valve 46, and into the pumping chamber 12. The flow rate into the pumping chamber 12 may be controlled by controlling the pressure differential between the liquid supply source 64 and the pumping chamber 12. Such control may be effected by adjusting one or both of the air flow regulators 114 or by known means for directly controlling the compressed air source. Alternatively, the type of solenoid selected may be adjustable to partially closed valve positions. Additionally, the liquid inlet conduit 62 may be provided with a flow control valve. This flexibility in pressure and flow rate adjustment also permits control of the degree of swirling or turbulence occurring in the pumping chamber 12, where mixing or maintenance of fluid homogeneity is desired.

As the pumping chamber 12 begins to fill with liquid, the lower float 76 will be raised to an upper position. The pumping chamber 12 will continue to fill until the liquid reaches a level sufficient to raise the upper float 74 to an upper position. When this upper position is reached, a signal is sent to the control box 80, which in turn sends a signal to the solenoid valves 112,113 to change position to initiate an EMPTY stage. At the new position of the solenoid valves 112,113, compressed air from the compressed air source is redirected to flow through the air line 116 and into the pumping chamber 12. Liquid flow into the pumping chamber 12 ceases, and the chamber becomes pressurized.

Figure 8:
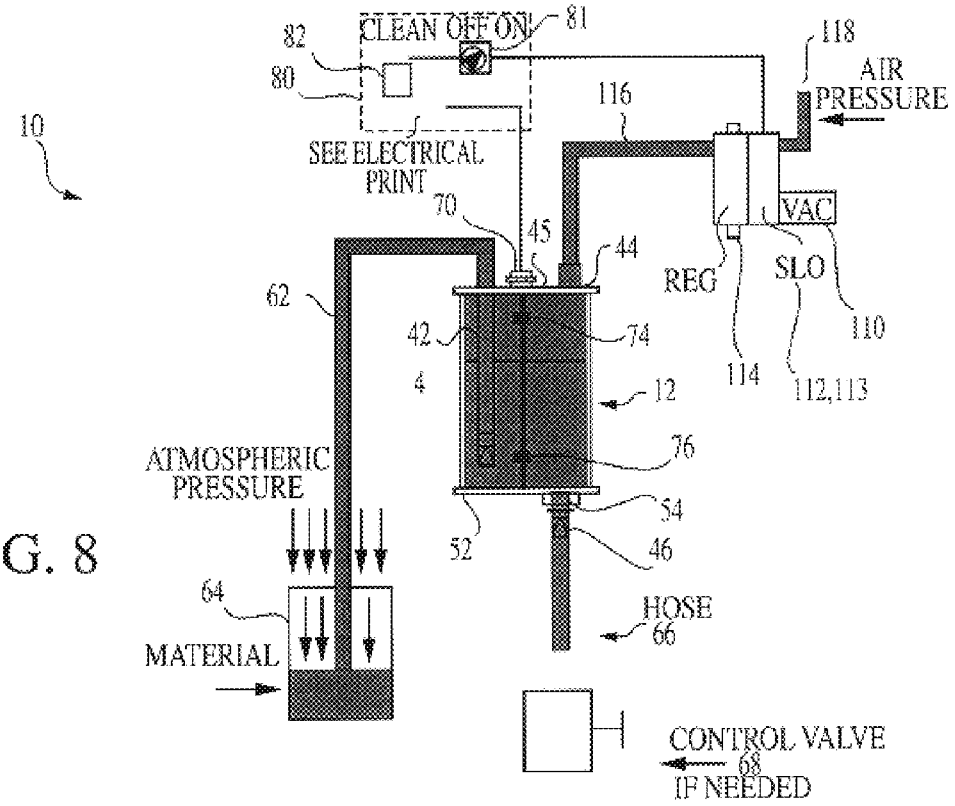
FIG. 8 is another diagrammatic view of the pumping system of FIG. 6.
Figure 9:
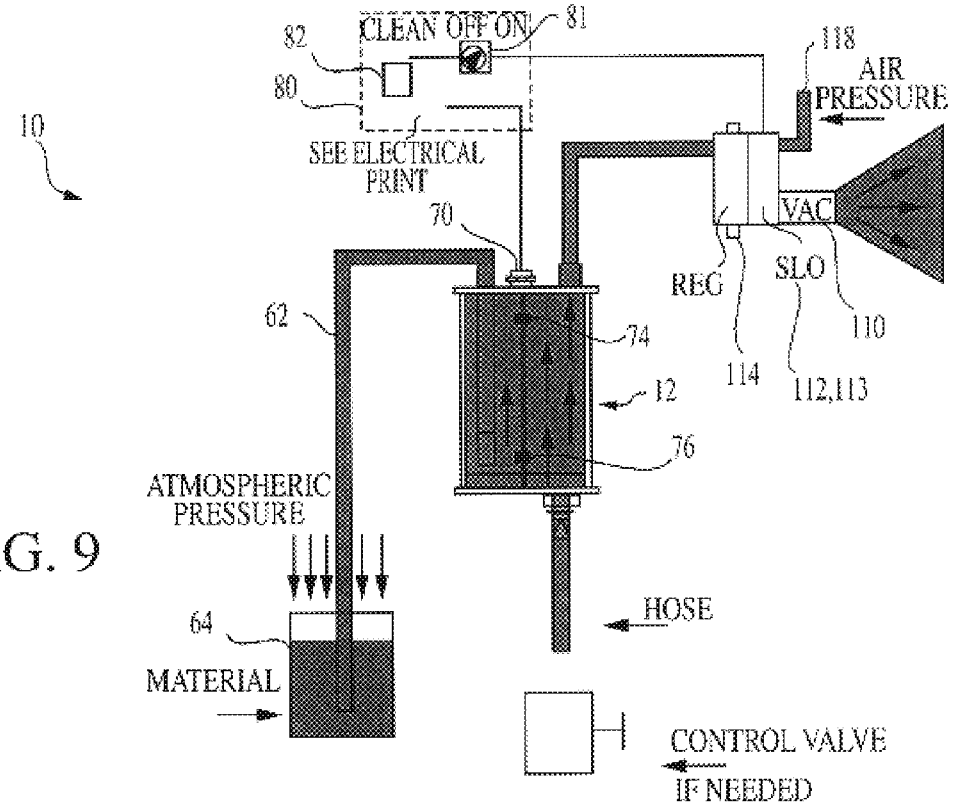
FIG. 9 is another diagrammatic view of the pumping system of FIG. 6.

As shown in FIG. 8, the compressed air introduced into the pumping chamber 12 forces the liquid within the chamber to flow through the liquid outlet 54 of the lower plate 52, and into the liquid outlet conduit 66 and its associated check valve 46. The flow rate out of the pumping chamber 12 may be adjusted by varying the pressure of the compressed air entering the pumping chamber 12 via the air pressure regulators 114, for example. Alternatively (or additionally), the flow rate may be adjusted using the control valve 68. As the pumping chamber 12 empties, the upper and lower floats 74, 76 will sequentially reach lower positions. As shown in FIG. 9, the movement of the lower float 76 to its lower position resets the system by sending a signal to the control box 80. The control box 80 sends an appropriate signal to trigger the solenoid valves 112,113, thereby switching the pumping system back to the FILL stage. The FILL stage again progresses as described above.

In addition to the FILL and EMPTY stages, the pumping system may be equipped to effect a CLEAN stage wherein virtually all liquid is purged from the pumping chamber 12 without an ensuing FILL stage. An advantageous method is to switch the solenoid valves 112,113 into the EMPTY stage position in order to direct compressed air into the pumping chamber 12 while simultaneously disabling or bypassing the normal effect of signals received in the control box 80 from the level sensor 70. A CLEAN position is provided at the selector switch 81 for this purpose.

Figures 10A, 10B:
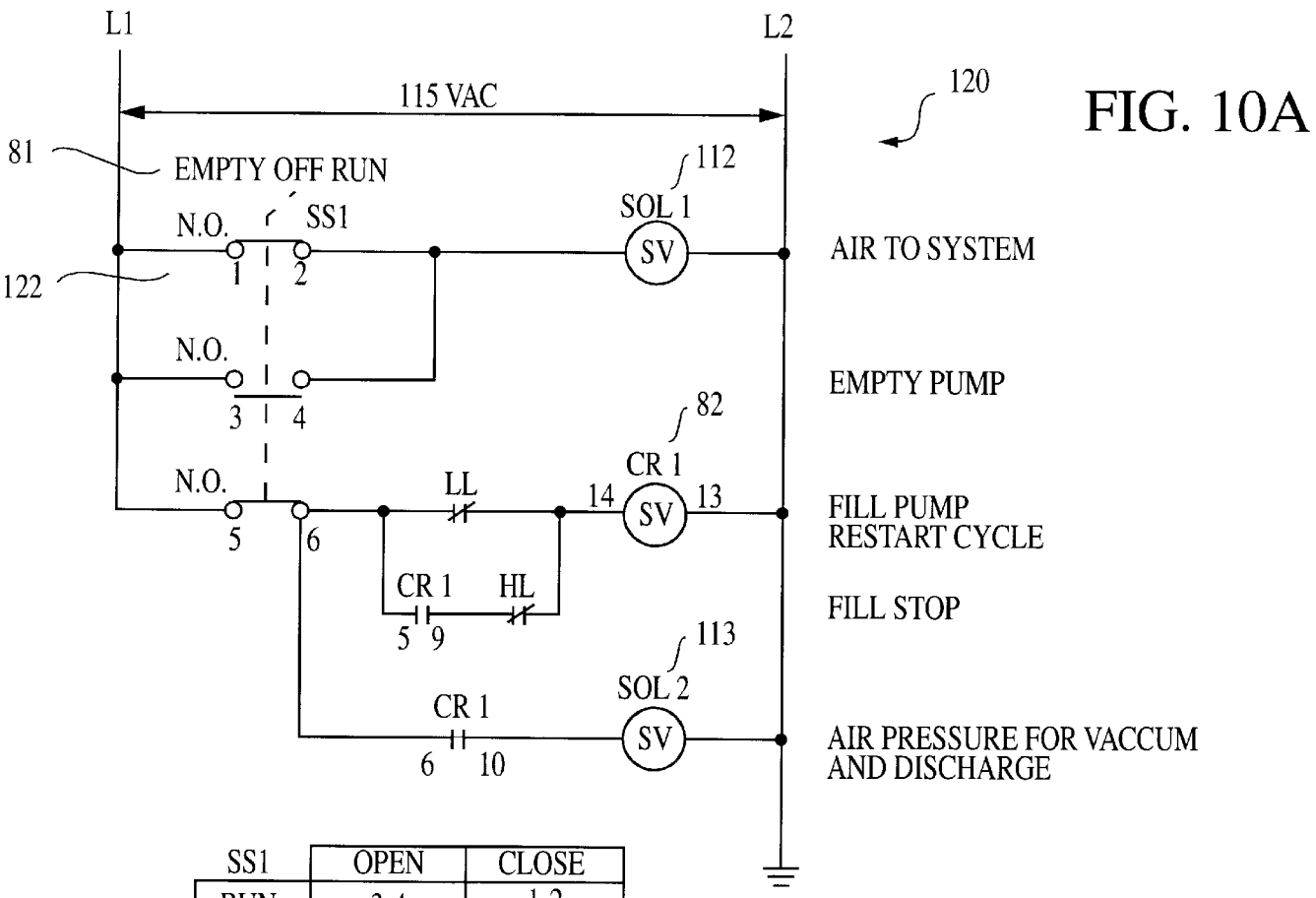
FIG. 10A is a schematic diagram of a control circuit which may be used in the present invention.
FIG. 10B is a table illustrating possible states of contact switches of the control circuit of FIG. 10A.

FIG. 10A is a schematic diagram of control circuitry 120 which may be utilized in the pumping system 10. Three normally open switches 122 are associated with the selector switch 81, and are distinguished by their respective terminal numbers as shown. Switch contact HL is associated with the reed switch of the upper float 74, and switch contact LL is associated with the reed switch of the lower float 76. FIG. 10B is a table showing the state of each switch 122 with respect to the position of the selector switch 81.

SECOND EMBODIMENT

Figure 11:
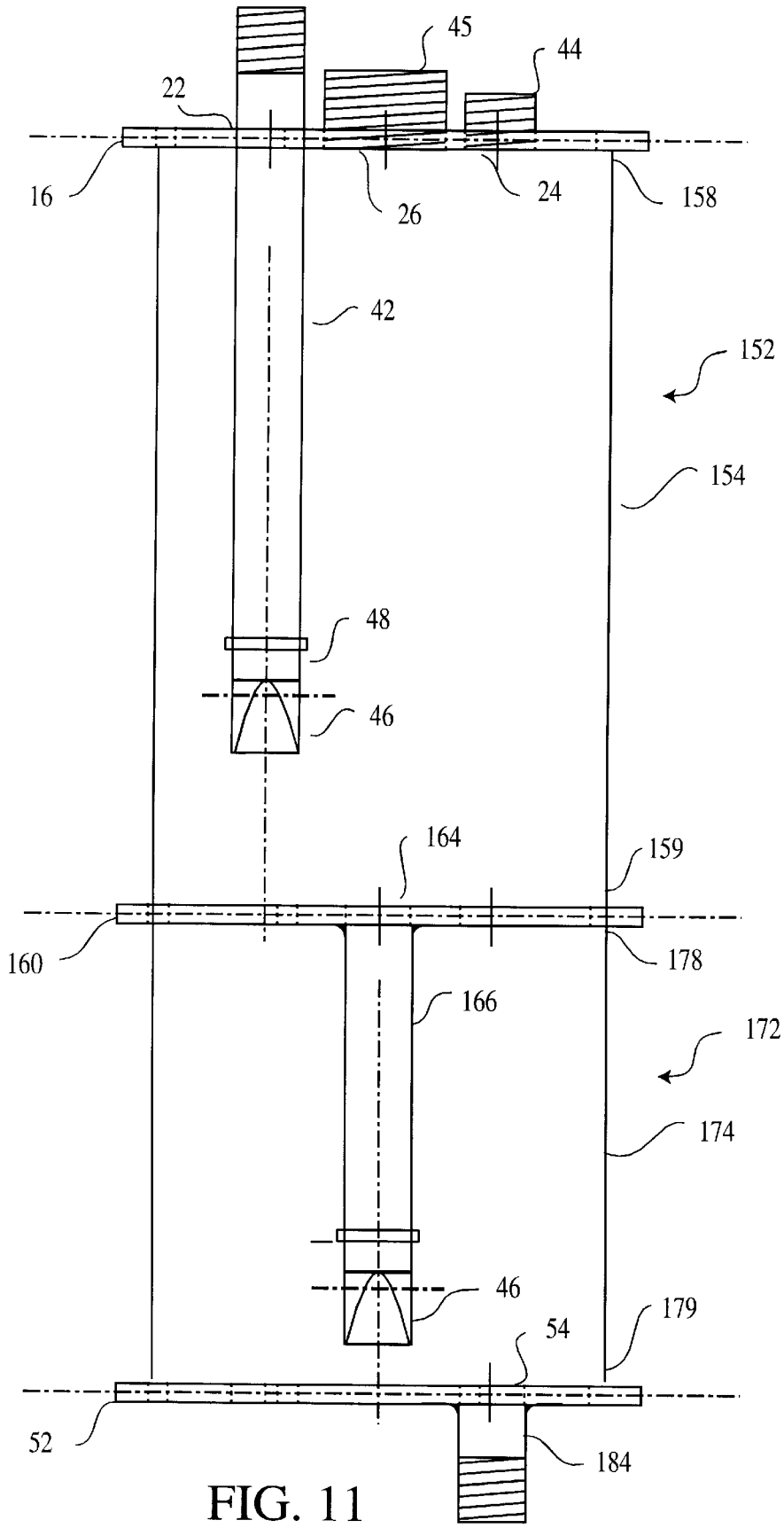
FIG. 11 is a side elevational view of a set of chambers according to one embodiment of the present invention.

FIGS. 11–20 illustrate a dual chamber pumping system 150. The pumping system 150 may be vertically oriented as shown in the Figures, or alternatively may be horizontally oriented. Referring to FIG. 11, the pumping system 150 has a first or upper chamber 152. For purposes of achieving modularity and manufacturing facility and efficiency, the design and construction of the upper chamber 152 may be derived from those of the pumping chamber 12 described above with respect to the single chamber pumping system 10. That is, the upper chamber 152 includes an outer wall or housing 154 which is preferably cylindrical and constructed of a transparent, rigid material such as an acrylic polymer. The upper chamber 152 is sealed in part by securing a barrier, such as an upper stainless steel plate 16, to an upper end 158 of the outer wall 154 as in the case of the pumping chamber 12 of the single chamber pumping system 10. The preferred upper plate 16 is similar in construction to the upper plate 16 of the single chamber pumping system 10. Thus, in the present example the upper plate 16 depicted in FIGS. 2 and 3, as well as its associated components, may be used in the dual chamber pumping system 150.

Figure 12:
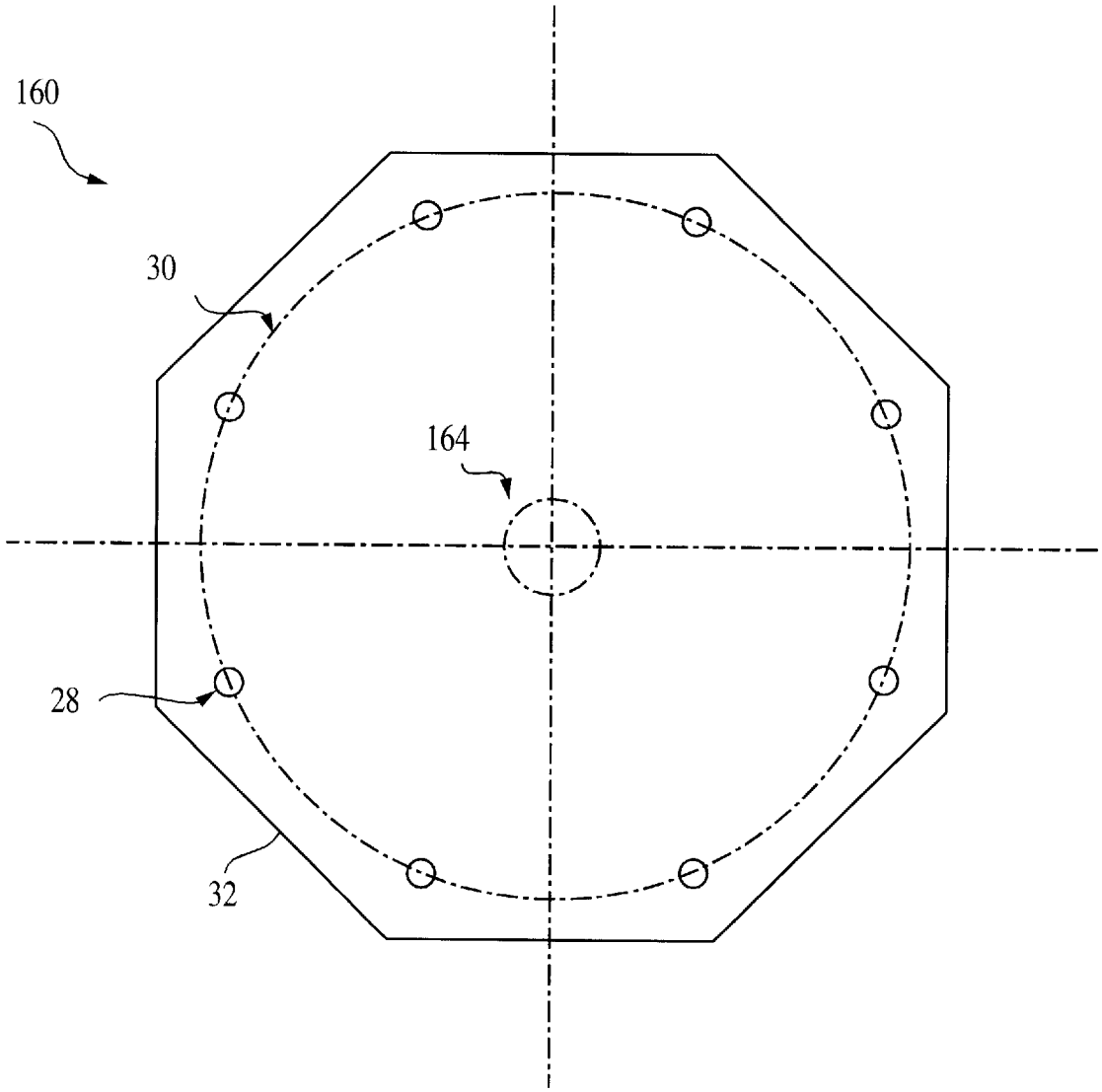
FIG. 12 is a top view of a plate of the set of chambers of FIG. 11.
Figure 13:
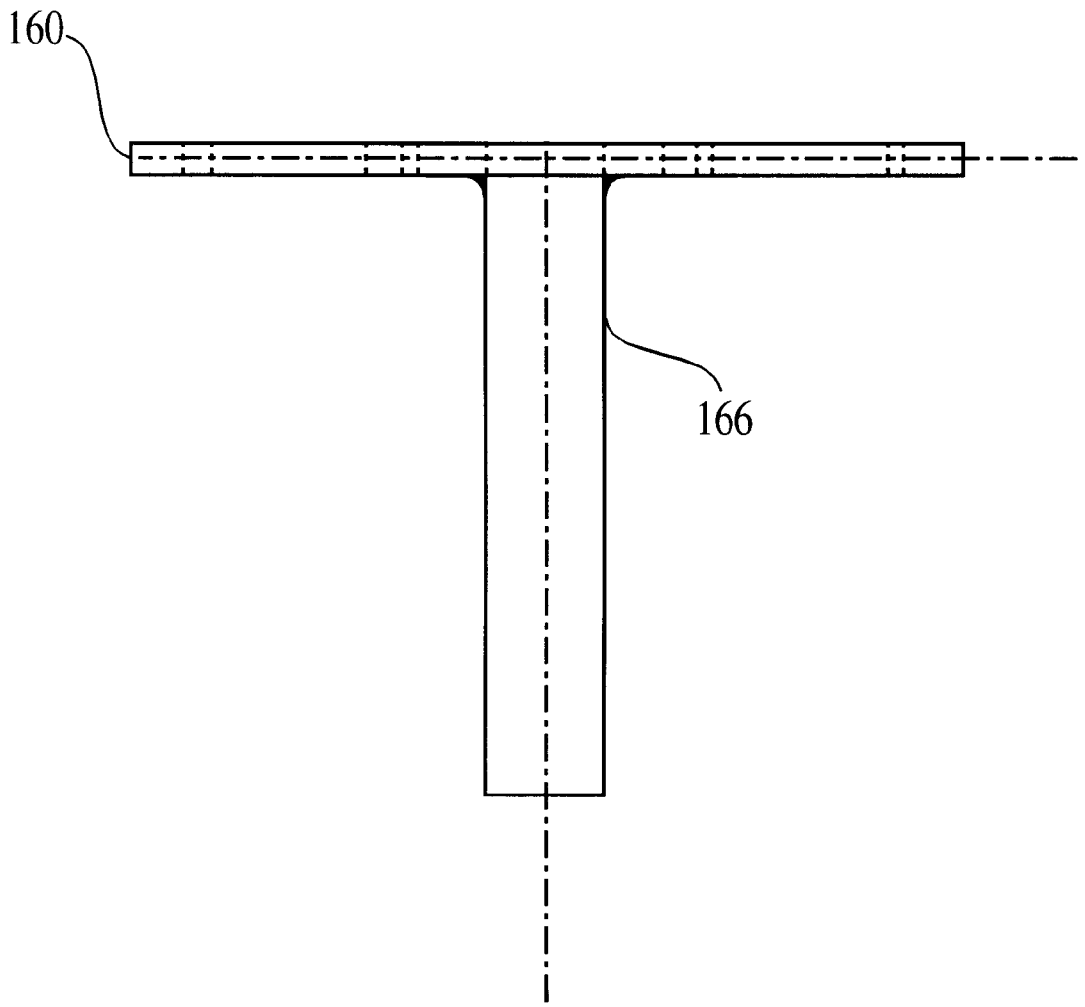
FIG. 13 is a side elevational view of the plate of FIG. 12.

The upper chamber 152 is sealed at a lower end 159 of the outer wall 154 to a barrier, such as a stainless steel intermediate plate 160. As shown in FIG. 12, the preferred intermediate plate 160 is shaped in a manner similar to that of the upper plate 16 of FIG. 2, and may include a plurality of tie rod mounting bores 28 equidistantly spaced in a circumferential pattern 30. A first liquid outlet 164 is bored through the intermediate plate 160. As shown in FIG. 13, a liquid outlet fitting 166 may be attached to the intermediate plate 160 such as by welding, in register with the first liquid outlet 164. A duck bill check valve 46 (see FIG. 11) should be fitted to the first liquid outlet 164 in the manner described above.

Figure 14:
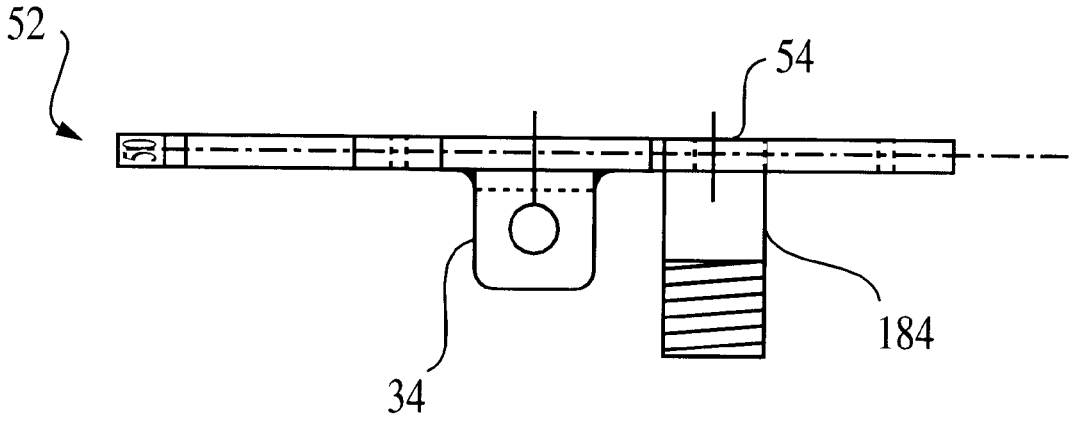
FIG. 14 is a side elevational view of another plate of the chambers of FIG. 11.

Referring to FIG. 11, the pumping system 150 also includes a second or lower chamber 172. The lower chamber 172 includes an outer wall 174 that preferably has the same design and construction as those of the outer wall 174 of the upper chamber 152. An upper end 178 of the outer wall 174 is sealed to the intermediate plate 160, while a lower end 179 is sealed to a barrier such as a stainless steel lower plate. If desired, the lower plate 52 of the single chamber pumping system 10 shown in FIG. 4 may be used. In the present pumping system 150, the lower plate 52 includes the liquid outlet 54, which in this case is a second liquid outlet. As shown in FIG. 14, a second liquid outlet fitting 184 may be secured to the second liquid outlet 52. In order to ensure a good seal for the upper and lower chambers 152,172, a plurality of tie rods 58 are extended through axially corresponding series of tie rod mounting bores 28 of the upper, intermediate and lower plates 16,160,52 and tightened down with box nuts or similarly functioning fasteners.

Representative dimensions for the primary structural components of the pumping system 150 shown in FIGS. 2, 4 and 11–13, without manufacturing tolerances, are as follows:

| | |
|---|---|
| Outer wall 154: | 6-in. length, 6-in. width or dia., 0.25-in. thickness |
| Outer wall 174: | 6-in. length, 6-in. width or dia., 0.25-in. thickness |
| Upper, intermediate, and lower plates 16, 160, 52: | 7 in. flat-to-flat, 0.25-in. thickness |
| Angle irons 34 | 1 × 1 in., with 0.3906-in. dia. hole |
| First liquid inlet 22: | 0.8594-in. dia. |
| Air port 24: | 0.8906-in. dia. |
| Level sensor mounting bore 26: | 1.5938-in. dia. |
| Tie rod mounting bores 28: | 0.2570-in. dia. |
| Tie rods 58: | 13.3750-in length, 0.2500-in. dia. |
| Circumferential patterns 30: | 6.3040-in. dia. |
| Liquid inlet fitting 42: | 8.8750-in. length, 1.5000 in. extending from top face 36 of upper plate 16 |
| Air port fitting 44: | 0.7500-in. length |
| Level sensor fitting 45: | 0.9889-in. length |
| First liquid outlet 164: | 0.8594-in. dia. |
| First liquid outlet fitting 166: | 4.8750-in. length |
| Second liquid outlet 54: | 0.8594-in. dia. |
| Second liquid outlet fitting 184: | 1.7500-in. length |

Figure 15:
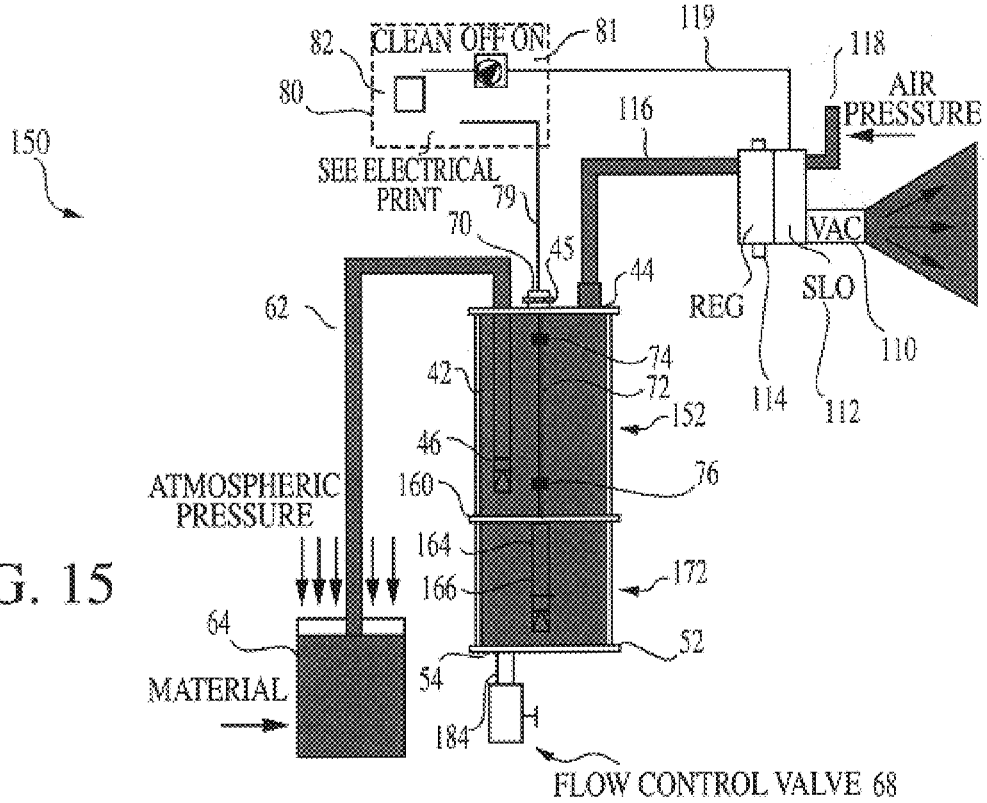
FIG. 15 is a diagrammatic view of another pumping system according to one embodiment of the present invention.

FIG. 15 illustrates the upper and lower chambers 152,172 installed in operative communication with other components of the pumping system 150. In this example, the upper chamber 152 has been selected as the pumping chamber and the lower chamber 172 has been selected as the receiving chamber. Certain reference numerals will be repeated to identify components similar to those of the single chamber pumping system 10.

A liquid inlet conduit 62 provides fluid communication between the liquid inlet fitting 42 of the upper chamber 152 and a liquid supply source 64. The liquid inlet conduit 62 may include one or more hoses, pipes, elbow fittings and the like as needed. A control valve 68 may be installed in communication with the liquid outlet fitting 184 of the lower chamber 172 to regulate the flow rate of liquid out of the pumping system 150. Optionally, a control valve (not shown) may also be installed on the liquid inlet conduit 62 to regulate the flow rate of liquid into the upper chamber 152. A level sensor 70 or equivalent measurement device is installed within the upper chamber 152. The level sensor 70 described in connection with the single pumping system 10 may be selected for the present pumping system 150, and mounted at the level sensor mounting fitting 45 as shown in FIG. 14. Also, the vacuum generator 110, solenoid valves 112,113, air flow regulators 114 and compressed air source of the single chamber pumping system 10 may likewise be provided in the present pumping system 150. In order to maintain a desired fluid pressure within the lower chamber 172 and thereby control the flow rate of liquid out of the lower chamber 172, use of the flow control valve 68 shown in FIG. 15 through 20 may be sufficient for controlling flow out of the lower chamber 172. The control box 80 and control circuitry 120 described in FIGS. 10A and 10B are appropriate to realize the operation of the pumping system 150.

Figure 16:
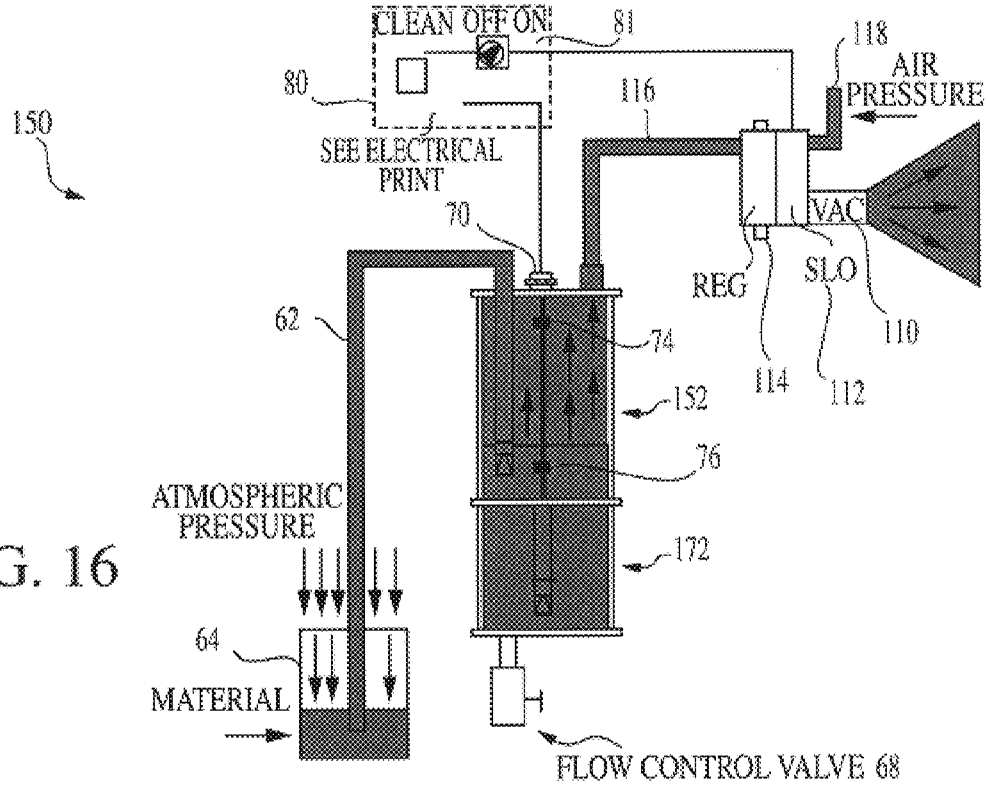
FIG. 16 is another diagrammatic view of the pumping system of FIG. 15.
Figure 17:
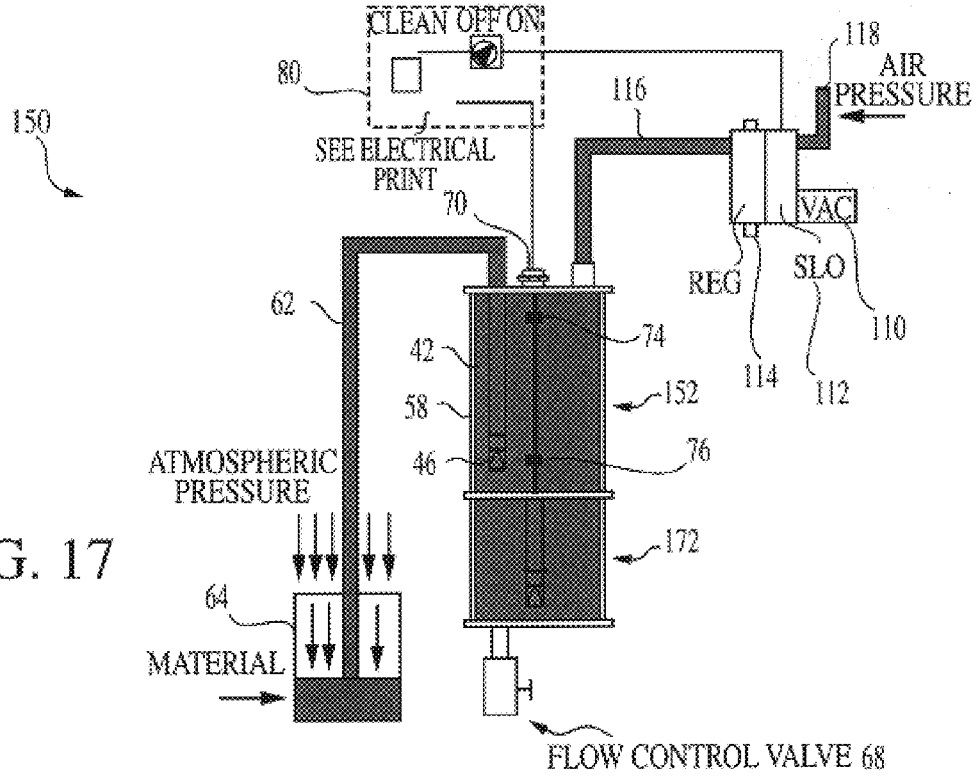
FIG. 17 is another diagrammatic view of the pumping system of FIG. 15.

The operation of the pumping system 150 will now be described with reference to FIGS. 15–20. For the sample embodiment shown, it is assumed that the liquid supply source 64 is open to the atmosphere and thus subject to ambient conditions. The solenoid valves 112,113 are energized to initiate the FILL stage, wherein air from the compressed air source is directed through the vacuum generator 110. Fluid pressure in the upper chamber 152 will drop below that of the liquid supply source 64, forcing liquid to flow into the upper chamber 152 as shown in FIG. 16. As shown in FIG. 17, the upper chamber 152 continues to fill with liquid until the level of liquid raises the upper float 74 to its upper position. With the upper float 74 triggered, the pumping system 150 changes to the EMPTY stage and the solenoid valves 112,113 switch position from vacuum to compressed air flow. Flow into the upper chamber 152 ceases at this point.

Figure 18:
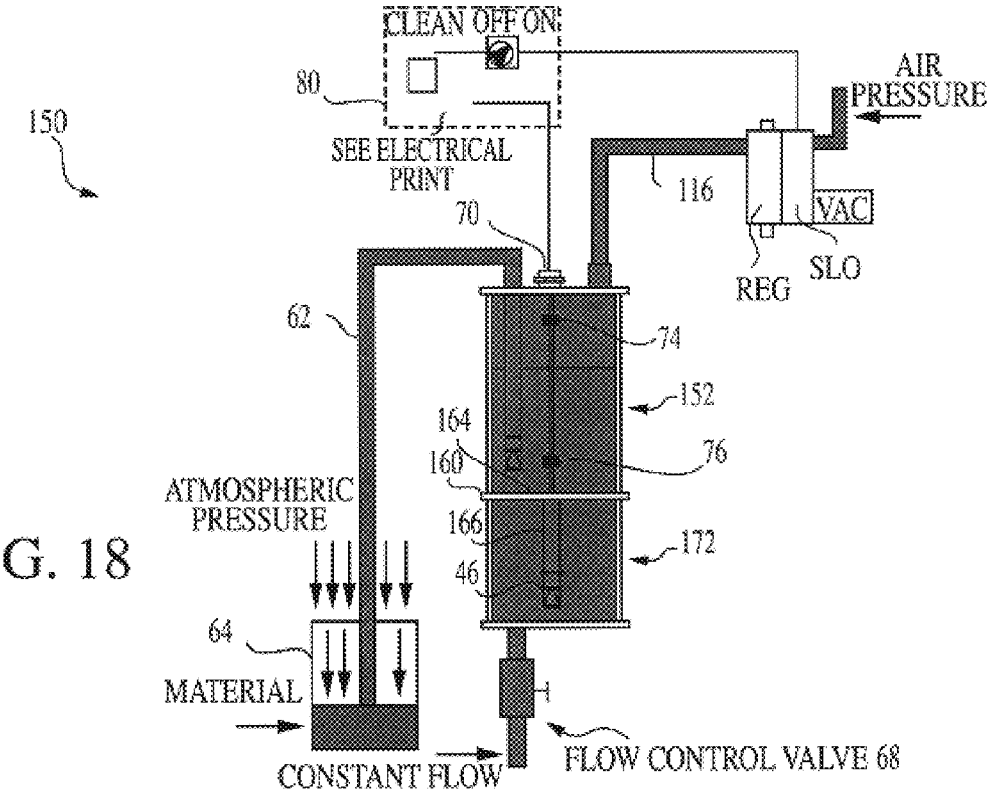
FIG. 18 is another diagrammatic view of the pumping system of FIG. 15.

As shown in FIG. 18, the compressed air flowing into the upper chamber 152 will increase the pressure within the upper chamber 152 to a magnitude greater than that of the lower chamber 172, thereby causing liquid to flow into the lower chamber 172 via the first liquid outlet 164 of the intermediate plate 160, the first liquid outlet fitting 166, and its check valve 46. The lower chamber 172 will fill to a desired maximum level. That level will depend on the pressure setting of the compressed air entering the upper chamber 152 and the flow rate setting for liquid discharging from the lower chamber 172, such as by the control valve 68. These settings are adjustable, either manually or automatically through the use of appropriate wiring and circuitry. Once the liquid in the lower chamber 172 reaches the desired maximum level it will begin to flow out of the lower chamber 172 through the second liquid outlet 182. Through adjustment of the settings just described, the level of liquid in the lower chamber 172 may be kept substantially constant at or near the maximum. This in turn will ensure a substantially constant fluid pressure within the lower chamber 172 and a constant rate of flow out the lower chamber 172, regardless of whether the pumping system 150 is in its FILL or EMPTY stage.

Figure 19:
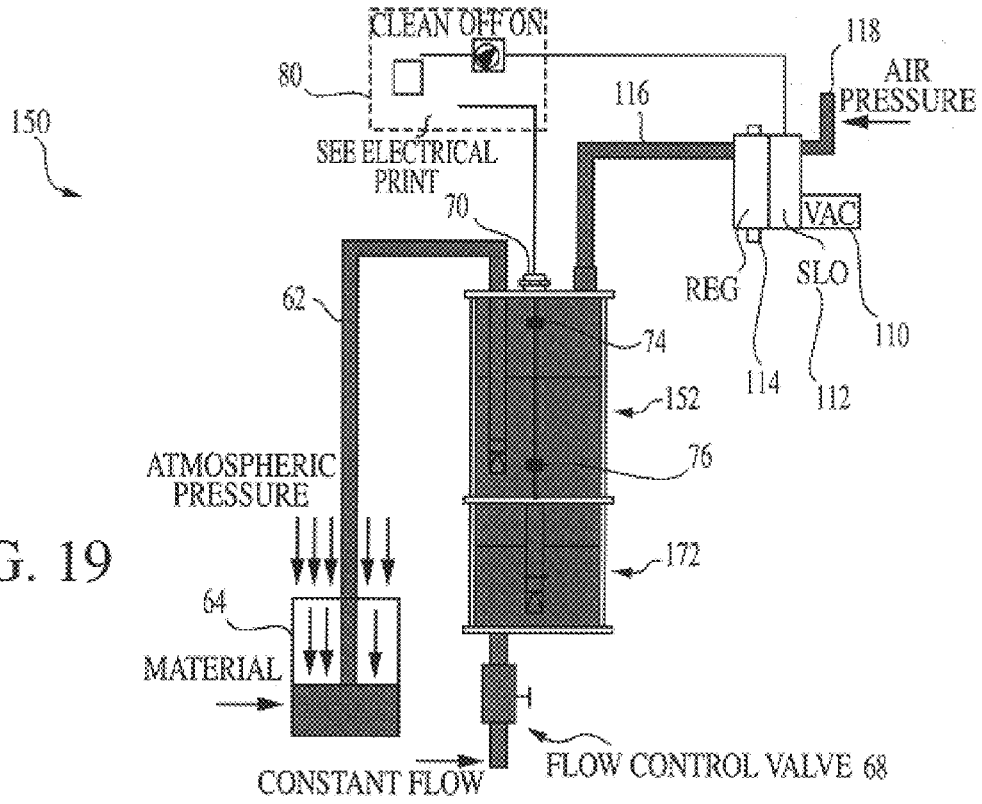
FIG. 19 is another diagrammatic view of the pumping system of FIG. 15.

As shown in FIG. 19, the pumping system 150 may be adjusted such that the level of liquid in the lower chamber 172 is permitted to drop below the maximum as liquid is transferred in from the upper chamber 152 and as liquid is discharged from the lower chamber 172. However, a constant flow rate out of the lower chamber 172, and thus a constant fluid pressure within the lower chamber 172, may still be ensured through the use of the air line 116, control valve 68, or a combination of these components. Optionally, an additional air line (not shown) may run to the lower chamber 172 to provide further control of pressure and flow rate conditions therein.

Figure 20:
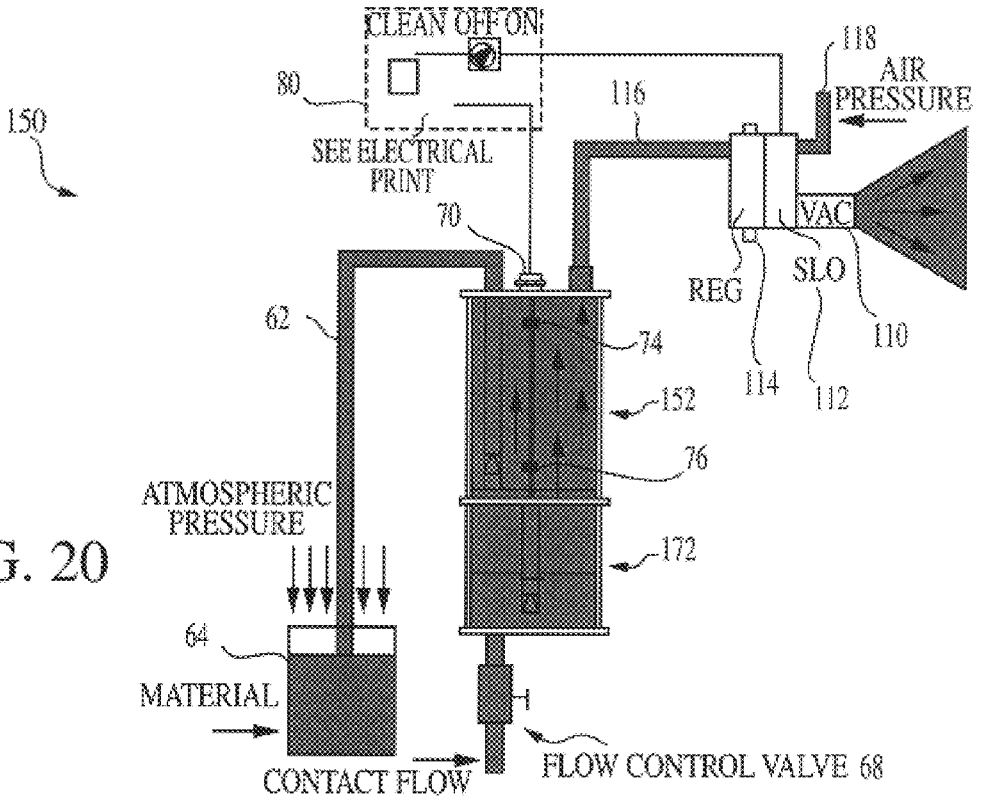
FIG. 20 is another diagrammatic view of the pumping system of FIG. 15.

Referring to FIG. 20, as liquid continues to be pumped out of the upper chamber 152 and transferred into the lower chamber 172 during the EMPTY stage, the level of liquid in the upper chamber 152 will eventually fall to a point at which the lower float 76 reaches its lower position. The pumping system 150 will then switch back to its FILL stage and the process described above is repeated, with a constant flow rate out of the lower chamber 172 being maintained if desired. As in the case of the single pumping system 10, the present pumping system 150 may be configured so as to enable a CLEAN stage when the need arises.

Figure 21:
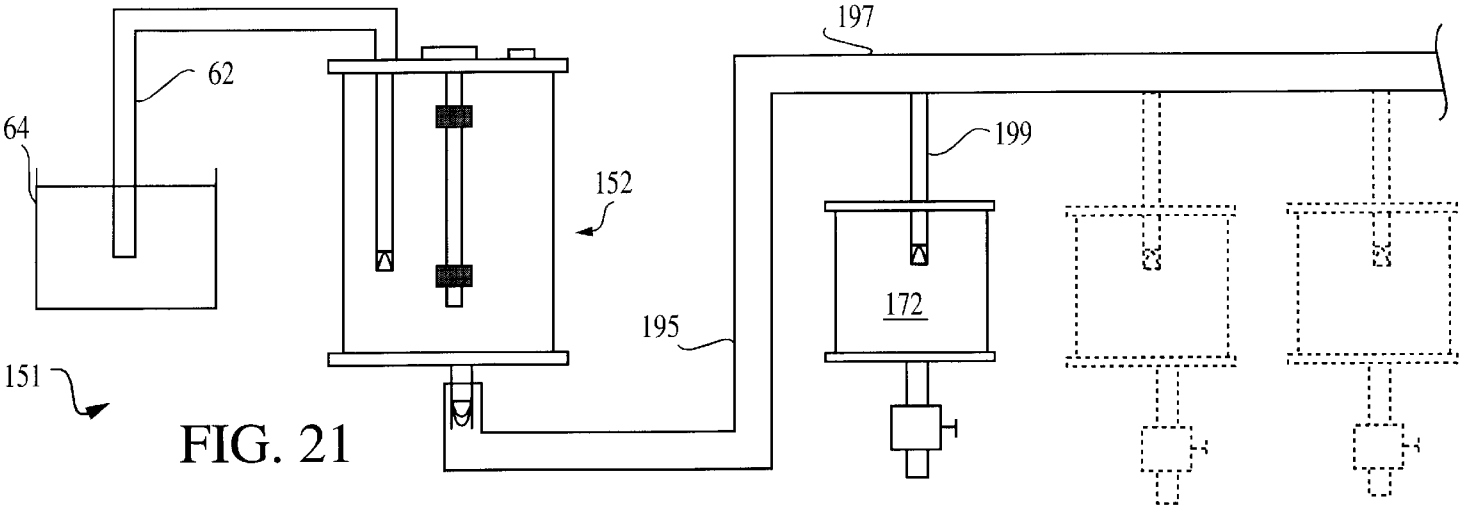
FIG. 21 is a diagrammatic view of another pumping system according to one embodiment of the present invention.

The pumping system 150 may be modified without undue effort in various ways. Modifications will depend on the particular role the pumping system 150 is to serve as part of a larger industrial application. For example, FIG. 21 illustrates an alternative embodiment wherein the first chamber 152 is disposed at a distance from one or more second chambers 172. Liquid pumped from the first chamber 152 may be directed into an outlet conduit 195 and main header or manifold 197. The liquid flows into the second chambers 172 via branch conduits 199. Such an arrangement may be advantageous in a case where a large quantity of liquid is intended to supply a number of destinations at different locations. The volume of the first chamber 152 may be quite large relative to that of the second chambers 172. Appropriate control devices and circuitry may be provided in a manner analogous to that described above.

Figure 22:
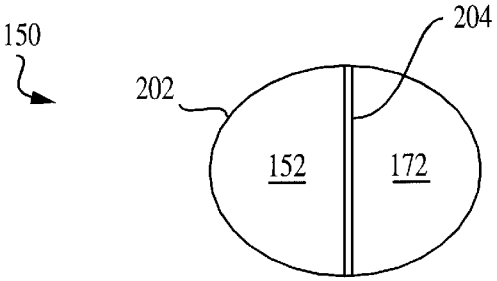
FIG. 22 is a top view of another set of chambers according to one embodiment of the present invention.
Figure 23:
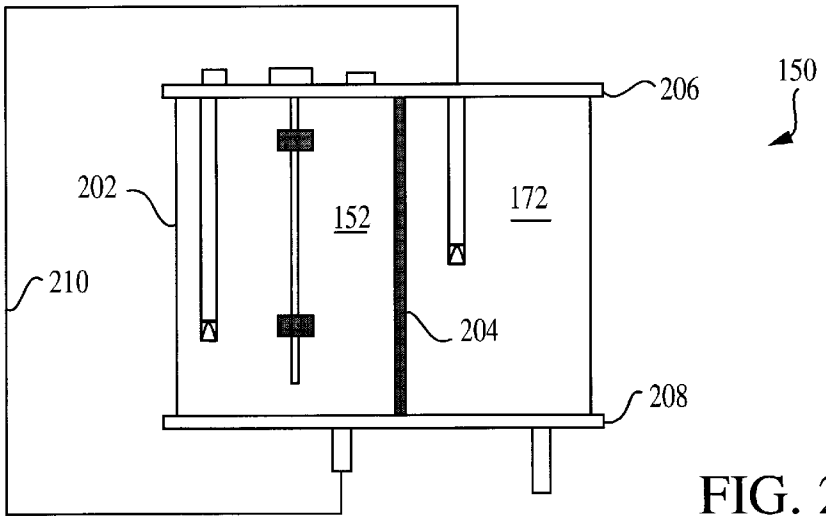
FIG. 23 is a side elevational view of the set of chambers of FIG. 22.

FIGS. 22 and 23 illustrate another alternative embodiment wherein the first and second chambers 152,172 of the pumping system 150 share an outer wall 202. The outer wall 202 may be cylindrical or rectilinear in cross-section. An inner wall 204 is disposed along a chordal line within the outer wall 202, and defines a boundary between the first and second chambers 152,172. Ends of the outer wall 202 are closed and sealed by first and second plates 206,208. A transfer line 210 carries liquid pumped from the first chamber 152 into the second chamber 172. The liquid may enter the second chamber 172 from the first plate 206 as shown, or it may enter from the second plate 208 if desired. Appropriate control devices and circuitry may be provided in a manner analogous to that described above.

Figure 24:
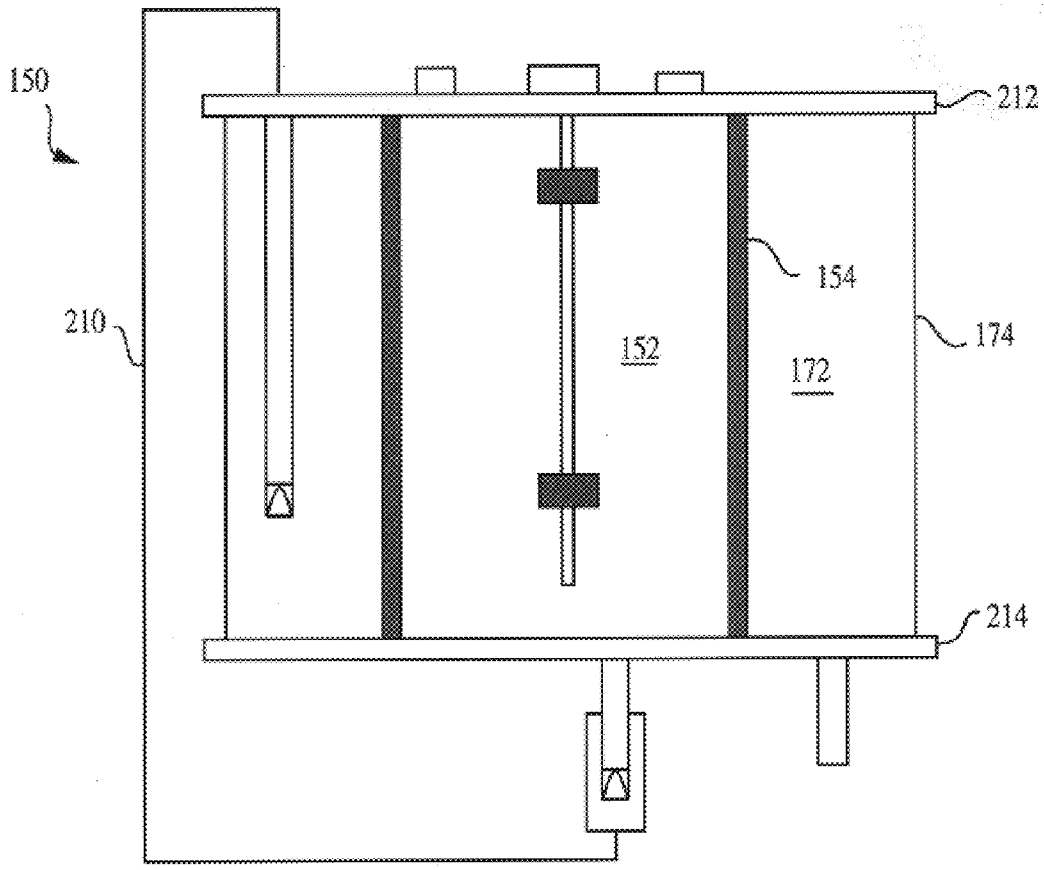
FIG. 24 is a side elevational view of another set of chambers according to one embodiment of the present invention.
Figure 25:
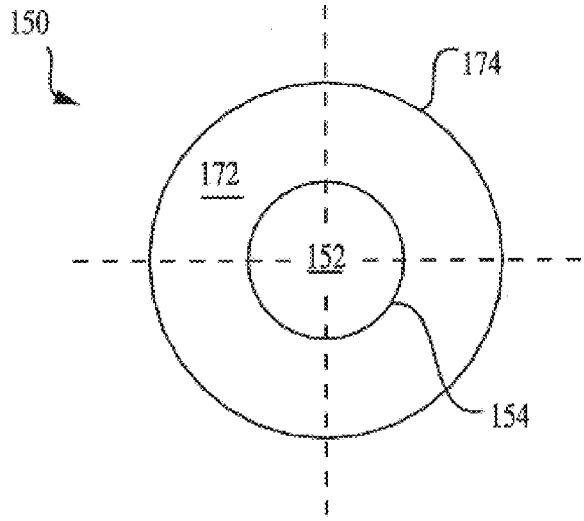
FIG. 25 is a top view of the set of chambers of FIG. 24.

FIGS. 24 and 25 illustrate a nested configuration for the pumping system 150. The first chamber 152 and outer wall 154 are nested within the second chamber 172 and outer wall 174. Ends of the first and second outer walls 154, 174 are closed and sealed by first and second plates 212,214, and a transfer line 210 is provided to carry liquid pumped from the first chamber 152 into the second chamber 172. It will be understood that this configuration may modified such that the second chamber 172 is nested within the first chamber 152, with appropriate control devices and circuitry provided as described above.

THIRD EMBODIMENT

FIGS. 26–30 illustrate a triple chamber pumping system 250. Many of the components selected for the pumping system 250 may be equivalent to those of the single or dual chamber pumping systems 10,150, and thus will be identified where appropriate with the same reference numerals. The pumping system 250 may be adapted to transfer the same type of liquid from multiple liquid supply sources or, as in the following example, may be adapted to permit mixing of different liquids from different liquid supply sources.

Figure 26:
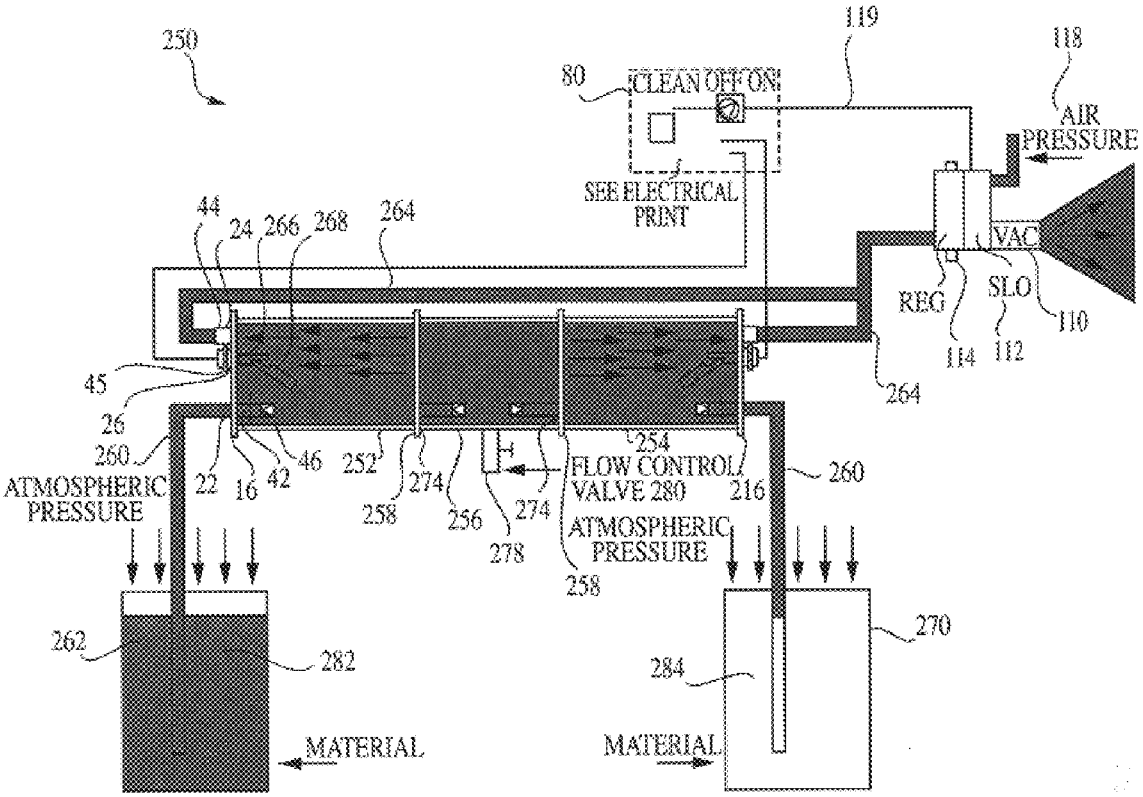
FIG. 26 is a diagrammatic view of another pumping system according to one embodiment of the present invention.

Referring to FIG. 26, the pumping system 250 is preferably horizontally oriented. The pumping system has a first end chamber 252, a second end chamber 254, and an intermediate chamber 256. In the embodiment shown in FIG. 26, the first end chamber 252 is closed and sealed at its ends by barriers such as a first plate 16 and a second plates 258. Likewise, the intermediate chamber 256 is bounded by the second plate and a similarly structured third plate 258, and the second end chamber 254 is bounded by the third plate 258 and a fourth plate 16. The fourth plate 16 may be similar in structure to the first plate 16.

The first end chamber 252 includes a first liquid inlet 22, a first air port 24, and a first level sensor mounting bore 26. A liquid inlet fitting 42 is secured to the first liquid inlet 22 and preferably includes a duck bill check valve 46. An air port fitting 44 is secured to the first air port 24, and a level sensor fitting 45 is secured to the first level sensor mounting bore 26. A liquid inlet conduit 260 provides fluid communication between a first liquid supply source and the first liquid inlet 22. A first air line 264 provides communication between the first air port 24 and a compressed air source (not shown), vacuum generator 110, solenoid valves 112,113, and air flow regulators 114. A level sensor 266 is installed at the level sensor fitting 45. In the present embodiment, the preferred level sensor 266 is side-mounted at the first plate 16 and includes a pivoting float 268 and internal reed switch (not shown). This level sensor 266 is available from Thomas Products, Ltd. and designated as Model 5100. The second end chamber 254 is similarly equipped, and includes a second liquid inlet 22, second air port 24, second level sensor mounting bore 26, second air line 264, and level sensor 266. A liquid inlet conduit 260 into the second chamber 254 runs from a second liquid supply source 270. A control box 80 is provided to house appropriate circuitry in electrical communication via wiring among the various control devices as described above.

The first and second chambers 252,254 respectively include first and second liquid outlets 274 leading into the intermediate chamber 256. The intermediate chamber 256 is provided with a third liquid outlet 278 and control valve 280 from which liquid is discharged from the pumping system 250. Representative dimensions for the primary structural components of the pumping system 250 may, if desired, be derived from those of the single or dual chamber pumping systems 10,150. For instance, the first and second end chambers 252,254 may be sized from the first chamber 152 of the dual chamber pumping system 150, and the intermediate chamber 256 may be sized from the second chamber 174 of the dual chamber pumping system 150.

Figure 27:
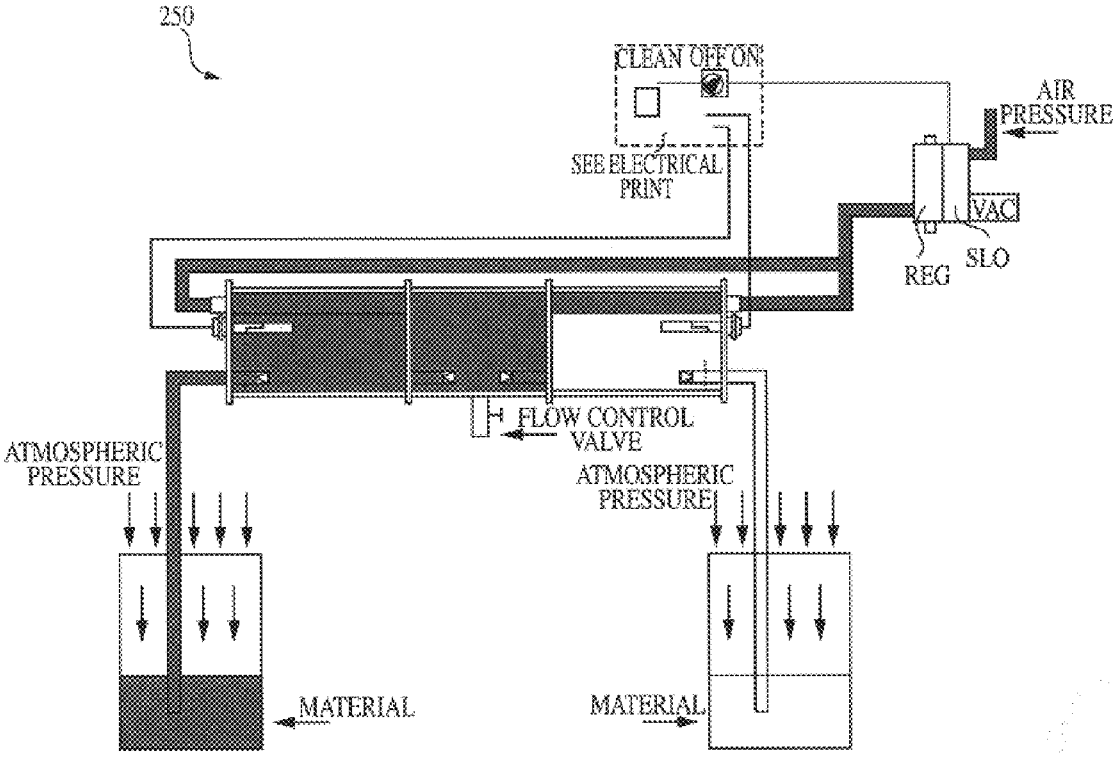
FIG. 27 is another diagrammatic view of the pumping system of FIG. 26.

In operation, the pumping system 250 may be employed to mix a first liquid 282 from the first liquid supply source 262 with a second liquid 284 from the second liquid supply source 270. In the FILL stage, the solenoid valves 112,113 are energized and switched into a position permitting compressed air delivered over compressed air line 118 to flow through the vacuum generator 110. The fluid pressure in the first and second end chambers 252,254 will drop below that of the first and second liquid supply sources 262,270. As shown in FIG. 27, the first liquid 282 is forced to flow into the first end chamber 252 while the second liquid 284 is forced to flow into the second end chamber 254. As the first and second end chambers 252,254 begin to fill, the floats 268 of their respective level sensors 266 will reach upper positions, thereby triggering the solenoid valves 112,113 to switch from the FILL stage to the EMPTY stage. Compressed air is then directed into the first and second end chambers 252,254 causing liquid flow to cease.

Figure 28:
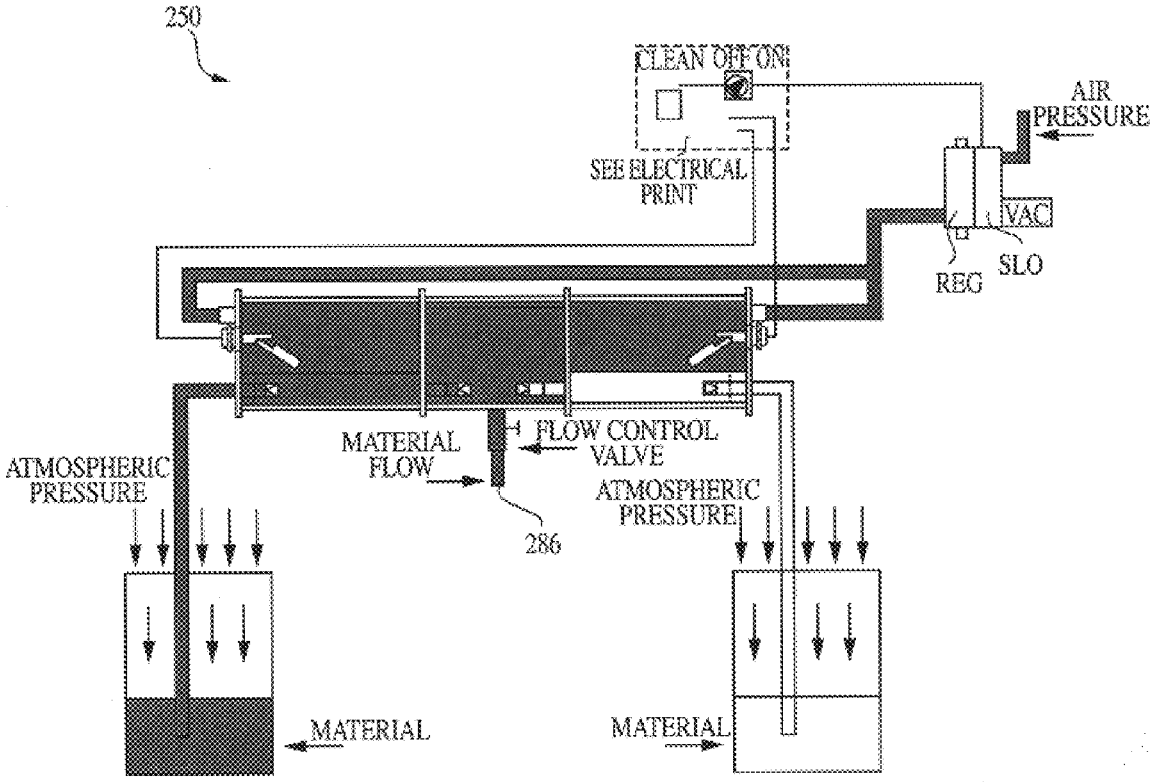
FIG. 28 is another diagrammatic view of the pumping system of FIG. 26.

As shown in FIG. 28, the compressed air will cause the first and second end chambers 252,254 to become pressurized to a magnitude greater than that of the intermediate chamber 256. The first and second liquids 282,284 drawn into the first and second end chambers 252,254 are then forced or pumped into the intermediate chamber 256 to produce a mixed liquid 286. The intermediate chamber 256 will fill to a maximum level, which may be determined by adjusting the pressure settings of the compressed air entering the first and second end chambers 252,254, the setting of the control valve 280, or a combination thereof. Once the mixed liquid 286 in the intermediate chamber 256 reaches this maximum, it will be forced to discharge out of the third liquid outlet 278. If desired, a constant discharge rate out of the third liquid outlet 278 may be ensured by maintaining a constant fluid pressure and volume in the intermediate chamber 256, in a manner analogous to that described above with respect to the dual chamber pumping system 150.

Figure 29:
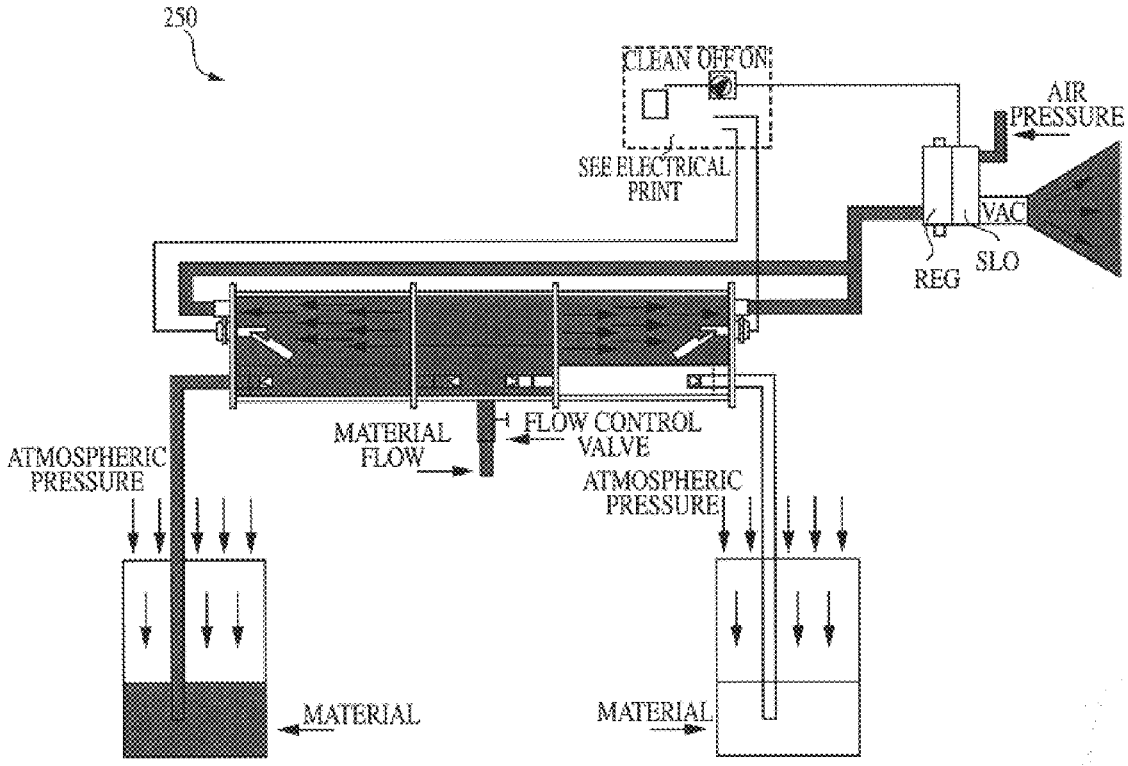
FIG. 29 is another diagrammatic view of the pumping system of FIG. 26; and, FIG. 30 is a schematic diagram of another control circuit which may be used in the present invention.

Referring to FIG. 29, as the level of liquid in the first and second end chambers 252,254 lowers, the floats 268 will move to lower positions and trigger the solenoid valves 112,113 to switch the pumping system 250 back to the FILL stage. A CLEAN stage may be effected as described above.

Figure 30:
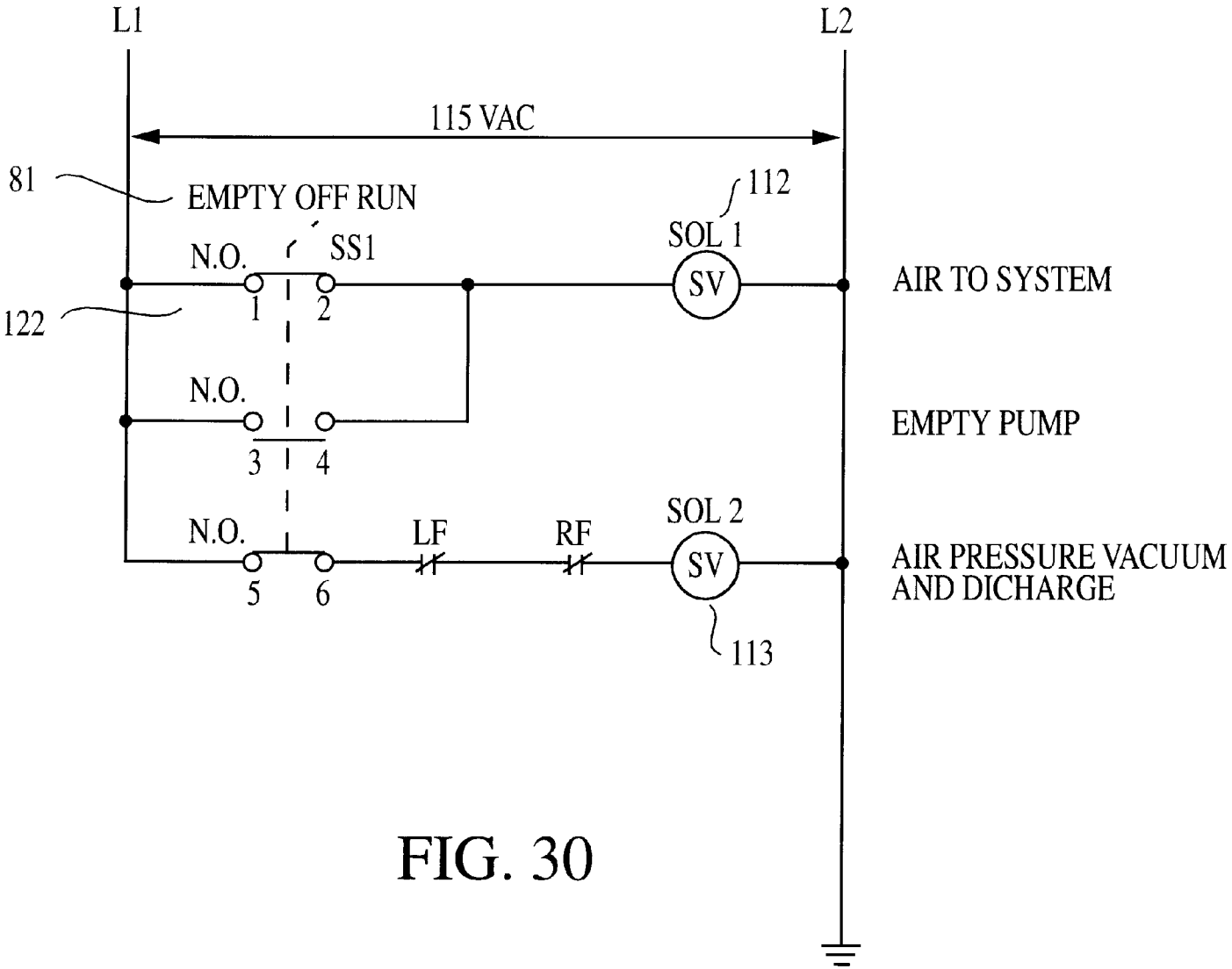

FIG. 30 is a schematic diagram of control circuitry 290 which may be utilized in the pumping system 250. Switch contacts LF and RF are associated respectively with the floats 268 of the first and second end chambers 252,254. The relationship between the state of each switch 122 and the positions of the selector switch 81 may be described as in FIG. 10B.

The configuration of the exemplary pumping system 250 described above may be modified in various ways. The first end chamber 252, second end chamber 254 and intermediate chamber 256 may have a common outer wall and be separated by internal partitions, to create chambers having pie-slice or rectilinear shapes. The first and second end chambers 252,254 may be disposed adjacent to each other and seated on a common intermediate plate or block, with the intermediate chamber 256 or other receiving chamber disposed below the intermediate plate. The first end chamber 252, second end chamber 254 and intermediate chamber 256 may be physically separated from each other, without common plates or blocks. Additional pumping and receiving chambers may be added to create an n-chamber pumping system. Where it is contemplated that the fluid supply and destination points will be separated by a long distance, several separate pumping chambers may be placed in series to minimize dynamic flow losses. Where several different fluids having significantly different properties are to be mixed, control of the pumping operation may be improved by making individual pressure adjustments to each pumping chamber used, or by sizing each chamber differently.

The modularity as well as the flexibility of the present invention should also be emphasized. The various components of the exemplary embodiments described above may be supplied to the end user as a kit. Thus, for instance, where simple reciprocatory or pulsing flow is desired, the end user may assemble the single-chamber pumping system 10 in the manner described above. Where constant volumetric flow is desired, the end user may convert the single-chamber pumping system 10 into the dual-chamber pumping system 150 by selecting the pumping chamber 12 as the upper chamber 152, assembling a remote lower chamber 172, and providing appropriate conduits. Or the end user may remove the lower plate 52 from the pumping chamber 12, replace it with the intermediate plate 160 and associated fittings, add the outer wall 174 and lower plate 52 5 thereto, and reassemble with longer tie rods 58. The single- or dual-chamber pumping systems 10,150 may be converted into the triple-chamber pumping system 250 or n-chamber pumping system via analogous methods. Additional regulators, solenoids, manifolds and other devices may be provided as needed. And because the pumping systems of the present invention are primarily driven by air pressure, many of the pneumatic controls may be substituted for electrical counterparts. Finally, while air is preferred, the systems described herein may be driven by any suitable gas, inert or otherwise, as long as the gas is compatible with the fluid to be pumped.

OTHER EMBODIMENTS

While the specific embodiments have been illustrated and described, numerous modifications come to mind without significantly departing from the scope of the invention, and the breadth of protection is only limited by the scope of the accompanying Claims. All embodiments described above by way of example, as well as their equivalents, are covered by one or more of the Claims as set forth below.

What is claimed is:

1. A pumping system comprising:

a pumping chamber having a liquid inlet and a liquid outlet, the liquid inlet communicating with a liquid supply source;

a second chamber in fluid communication with and sharing a common wall with the pumping chamber and having another outer wall not shared with another chamber;

means for sensing high and low liquid volume levels in the pumping chamber; and means for cycling the chamber between fill and empty states, wherein the cycling means operably communicates with the sensing means and includes means for decreasing a level of pressure within the pumping chamber below a level of pressure within the liquid supply source in response to a sensed low liquid volume level; and, means for increasing the level of pressure within the pumping chamber in response to a sensed high liquid volume level.

2. The pumping system of claim 1 wherein the pressure decreasing means includes a vacuum generator communicating with the pumping chamber, the pressure increasing means includes a compressed air source communicating with the pumping chamber, and the cycling means includes a solenoid unit in communication with the vacuum generator and the compressed air source.

3. The pumping system of claim 1 further comprising a receiving chamber communicating with the liquid outlet and having a receiving chamber outlet, and means for maintaining a constant flow rate of liquid through the receiving chamber outlet.

4. The pumping system of claim 1 wherein each chamber has a transparent wall.

5. The pumping system of claim 1 wherein each chamber has a horizontally oriented longitudinal axis.

6. The pumping system of claim 1 wherein each chamber has a vertically oriented longitudinal axis.

7. The pumping system of claim 1 wherein the first chamber includes an outer wall disposed between a first end barrier and an intermediate wall and the second chamber includes an outer wall disposed between the intermediate wall and a second end barrier and the first and second chambers include means for securing the first and second end barriers against the outer wall.

8. The pumping system of claim 7 wherein each end barrier is a plate and the securing means is a plurality of rods, and each rod is disposed between the plates.

9. The pumping system of claim 1 further comprising acontrol valve communicating with the first liquid outlet.

10. The pumping system of claim 1 further comprising an air regulator operably disposed between the first chamber and the vacuum generator.

11. The pumping system of claim 1 wherein the level detecting means comprises a level sensor including a reed switch and a float movably mounted in the first chamber.

12. The pumping system of claim 1 wherein the first air flow directing means and the second air flow directing means are integrated in a solenoid unit.

13. The pumping system of claim 12 wherein the solenoid unit includes a first valve for controlling air flow to the first chamber and a second valve for controlling air flow to the vacuum generator.

14. The pumping system of claim 1 further comprising an electrical control circuit operably communicating with the level detecting means and first and second air flow directing means.

15. A pumping system comprising:

a pumping chamber having a liquid inlet and a liquid outlet, the liquid inlet communicating with a liquid supply source;

a second chamber in fluid communication with and sharing a common wall with the pumping chamber and having another outer wall not shared with another chamber;

means for timing when the liquid volume level in the pumping chamber is a high liquid volume level or a low liquid volume level;

means for cycling the chamber between fill and empty states, wherein the cycling means operably communicates with the timing means and includes means for timing the flow of liquid into the pumping chamber; and means for timing the flow of liquid out of the pumping chamber;

means for decreasing a level of pressure within the pumping chamber below a level of pressure within the liquid supply source in response to a timed low liquid volume level; and, means for increasing the level of pressure within the pumping chamber in response to a timed high liquid volume level.

16. The pumping system of claim 15 wherein the pressure decreasing means includes a vacuum generator communicating with the pumping chamber, the pressure increasing means includes a compressed air source communicating with the pumping chamber, and the cycling means includes a solenoid unit in communication with the vacuum generator and the compressed air source.

17. The pumping system of claim 15 further comprising a receiving chamber communicating with the liquid outlet and having a receiving chamber outlet, and means for maintaining a constant flow rate of liquid through the receiving chamber outlet.

18. The pumping system of claim 15 wherein each chamber has a transparent wall.

19. The pumping system of claim 15 wherein each chamber has a horizontally oriented longitudinal axis.

20. The pumping system of claim 15 wherein each chamber has a vertically oriented longitudinal axis.

21. The pumping system of claim 15 wherein the first chamber includes an outer wall disposed between a first end barrier and an intermediate wall and the second chamber includes an outer wall disposed between the intermediate wall and a second end barrier and the first and second chambers include means for securing the first and second end barriers against the outer wall.

22. The pumping system of claim 21 wherein each end barrier is a plate and the securing means is a plurality of rods, and each rod is disposed between the plates.

23. The pumping system of claim 15 further comprising a control valve communicating with the first liquid outlet.

24. The pumping system of claim 15 further comprising an air regulator operably disposed between the first chamber and the vacuum generator.

25. The pumping system of claim 15 wherein the first air flow directing means and the second air flow directing means arc integrated in a solenoid unit.

26. The pumping system of claim 25 wherein the solenoid unit includes a first valve for controlling air flow to the first chamber and a second valve for controlling air flow to the vacuum generator.

27. The pumping system of claim 15 further comprising an electrical control circuit operably communicating with the level detecting means and first and second air flow directing means.

28. A pumping system comprising:

a first chamber having a liquid inlet and a first liquid outlet, the liquid inlet communicating with a liquid supply source;

a second chamber bounded by an outer wall and having a second liquid outlet and in fluid communication and sharing a common wall with the first liquid outlet;

a vacuum generator operably communicating with the first chamber and a compressed air source;

a liquid level detector adapted for detecting a level of liquid contained in the first chamber;

a liquid level detector adapted for detecting a level of liquid contained in the second chamber;

a first air flow directing element adapted for directing air flow from the compressed air source to the vacuum generator in response to a detected low level of liquid in the first chamber; and, a second air flow directing element adapted for directing the air flow from the compressed air source to the first chamber in response to a detected high level of liquid in the first chamber.

29. The pumping system of claim 28 further comprising a housing and a wall disposed within the housing, the wall having first and second sides, wherein the first side and the housing define the first chamber, and the second side and the housing define the second chamber.

30. The pumping system of claim 28 wherein the first chamber is nested within the second chamber.

31. The pumping system of claim 28 wherein the second chamber is nested within the first chamber.

32. The pumping system of claim 28 wherein the first liquid inlet is adapted to permit liquid to tangentially flow into the first chamber.

33. The pumping system of claim 28 further comprising means for regulating pressure within the second chamber.

34. The pumping system of claim 33 wherein the pressure regulating means comprises a flow control valve communicating with the second liquid outlet.

35. The pumping system of claim 28 further comprising means for controlling a maximum level of liquid contained in the second chamber.

36. The pumping system of claim 28 further comprising means for removing substantially all liquid from the first and second chambers.

37. A method for pumping liquid through two chambers in fluid communication with a liquid supply source, comprising the steps of:

providing an operable air connection between a vacuum generator and the chamber;

sensing a condition at which an amount of liquid in the first chamber has reached a predetermined upper limit;

causing a compressed air source to flow air into the first chamber to pressurize the first chamber and force liquid in the first chamber to discharge therefrom and into the second chamber;

sensing a condition at which the amount of liquid in the first chamber has reached a predetermined lower limit;

causing the compressed air source to flow air through the vacuum generator to lower a level of pressure within the chamber below a level of pressure within the liquid supply source, and to force liquid in the liquid supply source to flow into the first chamber;

controlling the flow rate of liquid out of the second chamber;

sensing a condition at which an amount of liquid in the second chamber has reached a predetermined upper limit; and increasing the flow rate of fluid out of the lower chamber once when the fluid pressure inside the second chamber reaches this upper limit.

38. The method of claim 37, further comprising:

a first inlet check valve adapted to prevent liquid from flowing from the first chamber toward the liquid supply source;

a second inlet check valve adapted to prevent liquid foam flowing from the second chamber toward the first chamber; and a flow control valve to regulate the flow out of the second chamber.

* * * * *